US009105243B2

(12) United States Patent
Shiomi

(10) Patent No.: US 9,105,243 B2
(45) Date of Patent: Aug. 11, 2015

(54) CONTROL DEVICE FOR LIQUID CRYSTAL DISPLAY DEVICE, LIQUID CRYSTAL DISPLAY DEVICE, METHOD FOR CONTROLLING LIQUID CRYSTAL DISPLAY DEVICE, PROGRAM, AND STORAGE MEDIUM FOR PROGRAM

(75) Inventor: Makoto Shiomi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 1305 days.

(21) Appl. No.: 12/736,644

(22) PCT Filed: Mar. 12, 2009

(86) PCT No.: PCT/JP2009/054712

§ 371 (c)(1),
(2), (4) Date: Oct. 26, 2010

(87) PCT Pub. No.: WO2009/157221

PCT Pub. Date: Dec. 30, 2009

(65) Prior Publication Data

US 2011/0037784 A1 Feb. 17, 2011

(30) Foreign Application Priority Data

Jun. 27, 2008 (JP) ..... 2008-169423

(51) Int. Cl.
*G09G 3/34* (2006.01)
*G09G 3/36* (2006.01)

(52) U.S. Cl.
CPC ..... *G09G 3/3426* (2013.01); *G09G 3/3611* (2013.01); *G09G 2320/0233* (2013.01);
(Continued)

(58) Field of Classification Search
CPC ..... G09G 3/3406; G09G 3/3426; G09G 3/36; G09G 2320/0233; G09G 2320/062; G09G 2320/0646; G09G 3/3611; G09G 2320/0276; G09G 2360/16; G09G 2340/0407; G09G 2340/0442; G09G 2340/0485; G09G 2340/06
USPC ..... 345/87, 89, 102, 690, 694, 698–699; 348/556
See application file for complete search history.

(56) References Cited

U.S. PATENT DOCUMENTS 5,101,440 A * 3/1992 Watanabe et al. ..... 382/168
5,534,940 A 7/1996 Sato et al.
(Continued)

FOREIGN PATENT DOCUMENTS

CN 101017260 8/2007
EP 1 705 636 9/2006
(Continued)

OTHER PUBLICATIONS

Abstract of Japanese Patent Publication JP06-178277, published on Jun. 24, 1994.
(Continued)

*Primary Examiner* — Temesgh Ghebretinsae
*Assistant Examiner* — Keith Crawley
(74) *Attorney, Agent, or Firm* — Harness, Dickey & Pierce, P.L.C.

(57) ABSTRACT

A liquid crystal driving circuit controls operations of display areas in a liquid crystal display panel based on a plural pieces of divided image data which are prepared by dividing image data for a single screen in accordance with the display areas in the liquid crystal display panel. In response to an luminance signal corresponding to an LED resolution generated by an LED resolution signal generating circuit based on image data for a single screen which is not divided, the LED driving circuit controls operations of LEDs provided in a backlight unit. With the configuration of at least one embodiment, according to a liquid crystal display device including a backlight, in a case where display image data for a single screen is divided into a plural pieces of divided image data for a plurality of areas of a display screen and images to be displayed in the plurality of areas are controlled based on the plural pieces of divided image data, display quality in a border area of the plurality of areas can be improved.

11 Claims, 20 Drawing Sheets

(52) U.S. Cl.
CPC ..... *G09G2320/0276* (2013.01); *G09G 2320/0646* (2013.01); *G09G 2340/0407* (2013.01); *G09G 2340/0442* (2013.01); *G09G 2340/0485* (2013.01); *G09G 2340/06* (2013.01); *G09G 2360/16* (2013.01)

(56) References Cited

U.S. PATENT DOCUMENTS

| | | | | |
|---|---|---|---|---|
| 5,666,164 | A | 9/1997 | Kondo et al. | |
| 5,940,132 | A | 8/1999 | Kondo et al. | |
| 6,710,781 | B1 | 3/2004 | Saito | |
| 7,039,254 | B1 * | 5/2006 | Maenaka et al. | 382/300 |
| 2002/0028028 | A1 | 3/2002 | Michel | |
| 2003/0169247 | A1 * | 9/2003 | Kawabe et al. | 345/204 |
| 2005/0184952 | A1 * | 8/2005 | Konno et al. | 345/102 |
| 2005/0219188 | A1 | 10/2005 | Kawabe et al. | |
| 2006/0055661 | A1 | 3/2006 | Kawaguchi | |
| 2006/0132383 | A1 | 6/2006 | Gally et al. | |
| 2006/0238487 | A1 * | 10/2006 | Shih | 345/102 |
| 2006/0279522 | A1 * | 12/2006 | Kurihara | 345/102 |
| 2007/0121039 | A1 | 5/2007 | Tago et al. | |
| 2007/0182682 | A1 | 8/2007 | Hong et al. | |
| 2007/0268238 | A1 * | 11/2007 | Chang et al. | 345/102 |
| 2008/0068402 | A1 * | 3/2008 | Ioka et al. | 345/660 |
| 2008/0100554 | A1 | 5/2008 | Mori | |
| 2008/0106641 | A1 | 5/2008 | Chou | |
| 2008/0180384 | A1 * | 7/2008 | Aoki et al. | 345/102 |
| 2008/0186272 | A1 * | 8/2008 | Huang et al. | 345/102 |
| 2008/0284719 | A1 | 11/2008 | Yoshida | |
| 2009/0028460 | A1 * | 1/2009 | Jung et al. | 382/274 |
| 2011/0037785 | A1 | 2/2011 | Shiomi | |

FOREIGN PATENT DOCUMENTS

| | | |
|---|---|---|
| EP | 1 936 600 | 6/2008 |
| JP | 2001-346070 | 12/2001 |
| JP | 3243861 | 1/2002 |
| JP | 2002-064704 | 2/2002 |
| JP | 2002-099250 | 4/2002 |
| JP | 2003-255915 | 9/2003 |
| JP | 2004-184937 | 7/2004 |
| JP | 2004-212503 | 7/2004 |
| JP | 2005-293265 | 10/2005 |
| JP | 2005-309338 | 11/2005 |
| JP | 2005-346639 | 12/2005 |
| JP | 2006-84710 | 3/2006 |
| JP | 3766231 | 4/2006 |
| JP | 2006-308665 | 11/2006 |
| JP | 2007-140404 | 6/2007 |
| JP | 2007-225871 | 9/2007 |
| JP | 2007-310319 | 11/2007 |
| JP | 2007-322944 | 12/2007 |
| JP | 2008-021207 | 1/2008 |
| JP | 2008-107715 | 5/2008 |
| JP | 2008-116554 | 5/2008 |
| JP | 2008-287118 | 11/2008 |
| JP | 2009-031585 | 2/2009 |
| RU | 2005129914 | 4/2007 |
| WO | WO 2009/157224 | 12/2009 |

OTHER PUBLICATIONS

International Search Report PCT/JP2009/054712.
International Search Report PCT/JP2009/054936.
International Search Report PCT/JP2008/072403.
U.S. Office Action mailed Jan. 24, 2013 for corresponding U.S. Appl. No. 12/736,660.
U.S. Office Action mailed Mar. 31, 2014 for corresponding U.S. Appl. No 12/736,660.

* cited by examiner

FIG. 14

INPUTTED DATA

5×5 DOTS

| | | | | |
|---|---|---|---|---|
| d11 | d12 | d13 | d14 | d15 |
| d21 | d22 | d23 | d24 | d25 |
| d31 | d32 | d33 | d34 | d35 |
| d41 | d42 | d43 | d44 | d45 |
| d51 | d52 | d53 | d54 | d55 |

×

DIFFERENCE FILTER

3×3 DOTS

| | | |
|---|---|---|
| a11 | a12 | a13 |
| a21 | a22 | a23 |
| a32 | a32 | a33 |

$$aij = \begin{pmatrix} -1 & 0 & 1 \\ -2 & 0 & 2 \\ -1 & 0 & 1 \end{pmatrix}$$

=

DIFFERENCE DATA

3×3 DOTS

| | | | | |
|---|---|---|---|---|
| | | | | |
| | b11 | b12 | b13 | |
| | b21 | b22 | b23 | |
| | b31 | b32 | b33 | |
| | | | | |

FIG. 15

INPUTTED IMAGE DATA

IMAGE A (CLEAR EDGE)

| | | | | | | | | |
|---|---|---|---|---|---|---|---|---|
| 0 | 0 | 0 | 0 | 0 | 1 | 1 | 1 | 1 |
| 0 | 0 | 0 | 0 | 0 | 1 | 1 | 1 | 1 |
| 0 | 0 | 0 | 0 | 0 | 1 | 1 | 1 | 1 |
| 0 | 0 | 0 | 0 | 0 | 1 | 1 | 1 | 1 |
| 0 | 0 | 0 | 0 | 0 | 1 | 1 | 1 | 1 |
| 0 | 0 | 0 | 0 | 0 | 1 | 1 | 1 | 1 |
| 0 | 0 | 0 | 0 | 0 | 1 | 1 | 1 | 1 |
| 0 | 0 | 0 | 0 | 0 | 1 | 1 | 1 | 1 |
| 0 | 0 | 0 | 0 | 0 | 1 | 1 | 1 | 1 |

CENTER VALUE (RATIO TO CENTER VALUE) 4 (1)
3×3 BLOCK AVERAGE VALUE (RATIO TO CENTER VALUE) 2.67 (0.67)
5×5 BLOCK AVERAGE VALUE (RATIO TO CENTER VALUE) 1.6 (0.4)
7×7 BLOCK AVERAGE VALUE (RATIO TO CENTER VALUE) 1.14 (0.29)

IMAGE B (THIN LINE)

| | | | | | | | | |
|---|---|---|---|---|---|---|---|---|
| 0 | 0 | 0 | 0 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |

CENTER VALUE (RATIO TO CENTER VALUE) 4 (1)
3×3 BLOCK AVERAGE VALUE (RATIO TO CENTER VALUE) 1.33 (0.33)
5×5 BLOCK AVERAGE VALUE (RATIO TO CENTER VALUE) 0 (0)
7×7 BLOCK AVERAGE VALUE (RATIO TO CENTER VALUE) 0 (0)

IMAGE C (IRREGULAR LINES)

| | | | | | | | | |
|---|---|---|---|---|---|---|---|---|
| 0 | 0 | 0 | 0 | 0 | 1 | 0 | 0 | 0 |
| 0 | 0 | 0 | 0 | 0 | 1 | 0 | 0 | 0 |
| 0 | 0 | 1 | 1 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |
| 0 | 0 | 0 | 0 | 0 | 1 | 0 | 0 | 0 |
| 0 | 0 | 1 | 1 | 0 | 1 | 0 | 0 | 0 |
| 0 | 0 | 1 | 1 | 0 | 1 | 0 | 0 | 0 |
| 0 | 0 | 0 | 0 | 0 | 1 | 0 | 0 | 0 |

CENTER VALUE (RATIO TO CENTER VALUE) 4 (1)
3×3 BLOCK AVERAGE VALUE (RATIO TO CENTER VALUE) 0.89 (0.22)
5×5 BLOCK AVERAGE VALUE (RATIO TO CENTER VALUE) -0.1 (-0)
7×7 BLOCK AVERAGE VALUE (RATIO TO CENTER VALUE) 0.16 (0.04)

HORIZONTAL DIFFERENCE IMAGE DATA

IMAGE A (CLEAR EDGE)

| | | | | | | |
|---|---|---|---|---|---|---|
| 0 | 0 | 0 | 4 | 4 | 0 | 0 |
| 0 | 0 | 0 | 4 | 4 | 0 | 0 |
| 0 | 0 | 0 | 4 | 4 | 0 | 0 |
| 0 | 0 | 0 | 4 | 4 | 0 | 0 |
| 0 | 0 | 0 | 4 | 4 | 0 | 0 |
| 0 | 0 | 0 | 4 | 4 | 0 | 0 |
| 0 | 0 | 0 | 4 | 4 | 0 | 0 |

IMAGE B (THIN LINE)

| | | | | | | |
|---|---|---|---|---|---|---|
| 0 | 0 | 0 | 4 | 0 | -4 | 0 |
| 0 | 0 | 0 | 4 | 0 | -4 | 0 |
| 0 | 0 | 0 | 4 | 0 | -4 | 0 |
| 0 | 0 | 0 | 4 | 0 | -4 | 0 |
| 0 | 0 | 0 | 4 | 0 | -4 | 0 |
| 0 | 0 | 0 | 4 | 0 | -4 | 0 |
| 0 | 0 | 0 | 4 | 0 | -4 | 0 |

IMAGE C (IRREGULAR LINES)

| | | | | | | |
|---|---|---|---|---|---|---|
| 1 | 1 | -1 | 3 | 0 | -4 | 0 |
| 2 | 2 | -2 | 2 | 0 | -4 | 0 |
| 1 | 1 | -1 | 3 | 0 | -3 | 1 |
| 0 | 0 | 0 | 4 | 0 | -2 | 2 |
| 1 | 1 | -1 | 3 | 0 | -3 | 1 |
| 3 | 3 | -3 | 1 | 0 | -4 | 0 |
| 3 | 3 | -3 | 1 | 0 | -4 | 0 |

VERTICAL DIFFERENCE IMAGE DATA

IMAGE A (CLEAR EDGE)

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

CENTER VALUE (RATIO TO CENTER VALUE) 0 (-)
3×3 BLOCK AVERAGE VALUE (RATIO TO CENTER VALUE) 0 (-)
5×5 BLOCK AVERAGE VALUE (RATIO TO CENTER VALUE) 0 (-)
7×7 BLOCK AVERAGE VALUE (RATIO TO CENTER VALUE) 0 (-)

IMAGE B (THIN LINE)

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

CENTER VALUE (RATIO TO CENTER VALUE) 0 (-)
3×3 BLOCK AVERAGE VALUE (RATIO TO CENTER VALUE) 0 (-)
5×5 BLOCK AVERAGE VALUE (RATIO TO CENTER VALUE) 0 (-)
7×7 BLOCK AVERAGE VALUE (RATIO TO CENTER VALUE) 0 (-)

IMAGE C (IRREGULAR LINES)

| | | | | | | |
|---|---|---|---|---|---|---|
| -1 | -3 | -3 | -1 | 0 | 0 | 0 |
| 0 | 0 | 0 | 0 | 0 | 0 | 0 |
| 1 | 3 | 3 | 1 | 0 | -1 | -3 |
| 0 | 0 | 0 | 0 | 0 | 0 | 0 |
| -1 | -3 | -3 | -1 | 0 | 1 | 3 |
| -1 | -3 | -3 | -1 | 0 | 0 | 0 |
| 1 | 3 | 3 | 1 | 0 | 0 | 0 |

CENTER VALUE (RATIO TO CENTER VALUE) 0 (-)
3×3 BLOCK AVERAGE VALUE (RATIO TO CENTER VALUE) 0 (-)
5×5 BLOCK AVERAGE VALUE (RATIO TO CENTER VALUE) 0 (-)
7×7 BLOCK AVERAGE VALUE (RATIO TO CENTER VALUE) 0 (-)

FIG. 16

IMAGE D (CLEAR EDGE)

| | | | | | | | | |
|---|---|---|---|---|---|---|---|---|
| 0 | 0 | 0 | 0 | 0 | 0 | 0 | 0 | 0 |
| 0 | 0 | 0 | 0 | 0 | 0 | 0 | 0 | 1 |
| 0 | 0 | 0 | 0 | 0 | 0 | 0 | 1 | 1 |
| 0 | 0 | 0 | 0 | 0 | 0 | 1 | 1 | 1 |
| 0 | 0 | 0 | 0 | 0 | 1 | 1 | 1 | 1 |
| 0 | 0 | 0 | 0 | 1 | 1 | 1 | 1 | 1 |
| 0 | 0 | 0 | 1 | 1 | 1 | 1 | 1 | 1 |
| 0 | 0 | 1 | 1 | 1 | 1 | 1 | 1 | 1 |
| 0 | 1 | 1 | 1 | 1 | 1 | 1 | 1 | 1 |

| | | | | | | |
|---|---|---|---|---|---|---|
| 0 | 0 | 0 | 0 | 0 | 1 | 3 |
| 0 | 0 | 0 | 0 | 1 | 3 | 3 |
| 0 | 0 | 0 | 1 | 3 | 3 | 1 |
| 0 | 0 | 1 | 3 | 3 | 1 | 0 |
| 0 | 1 | 3 | 3 | 1 | 0 | 0 |
| 1 | 3 | 3 | 1 | 0 | 0 | 0 |
| 3 | 3 | 1 | 0 | 0 | 0 | 0 |

| | | | | | | |
|---|---|---|---|---|---|---|
| 0 | 0 | 0 | 0 | 0 | -1 | -3 |
| 0 | 0 | 0 | 0 | -1 | -3 | -3 |
| 0 | 0 | 0 | -1 | -3 | -3 | -1 |
| 0 | 0 | -1 | -3 | -3 | -1 | 0 |
| 0 | -1 | -3 | -3 | -1 | 0 | 0 |
| -1 | -3 | -3 | -1 | 0 | 0 | 0 |
| -3 | -3 | -1 | 0 | 0 | 0 | 0 |

....CENTER VALUE (RATIO TO CENTER VALUE) 3 (1) .....CENTER VALUE (RATIO TO CENTER VALUE) -3 (1)
....3×3 BLOCK AVERAGE VALUE (RATIO TO CENTER VALUE) 2 (0.67) .....3×3 BLOCK AVERAGE VALUE (RATIO TO CENTER VALUE) -2 (0.67)
....5×5 BLOCK AVERAGE VALUE (RATIO TO CENTER VALUE) 1.36 (0.45) .....5×5 BLOCK AVERAGE VALUE (RATIO TO CENTER VALUE) -1.4 (0.45)
....7×7 BLOCK AVERAGE VALUE (RATIO TO CENTER VALUE) 1.02 (0.34) .....7×7 BLOCK AVERAGE VALUE (RATIO TO CENTER VALUE) -1 (0.34)

IMAGE E (THIN LINE)

| | | | | | | | | |
|---|---|---|---|---|---|---|---|---|
| 0 | 0 | 0 | 0 | 0 | 0 | 0 | 0 | 0 |
| 0 | 0 | 0 | 0 | 0 | 0 | 0 | 0 | 1 |
| 0 | 0 | 0 | 0 | 0 | 0 | 0 | 1 | 0 |
| 0 | 0 | 0 | 0 | 0 | 0 | 1 | 0 | 0 |
| 0 | 0 | 0 | 0 | 0 | 1 | 0 | 0 | 0 |
| 0 | 0 | 0 | 0 | 1 | 0 | 0 | 0 | 0 |
| 0 | 0 | 0 | 1 | 0 | 0 | 0 | 0 | 0 |
| 0 | 0 | 1 | 0 | 0 | 0 | 0 | 0 | 0 |
| 0 | 1 | 0 | 0 | 0 | 0 | 0 | 0 | 0 |

| | | | | | | |
|---|---|---|---|---|---|---|
| 0 | 0 | 0 | 0 | 0 | 1 | 2 |
| 0 | 0 | 0 | 0 | 1 | 2 | 0 |
| 0 | 0 | 0 | 1 | 2 | 0 | -2 |
| 0 | 0 | 1 | 2 | 0 | -2 | -1 |
| 0 | 1 | 2 | 0 | -2 | -1 | 0 |
| 1 | 2 | 0 | -2 | -1 | 0 | 0 |
| 2 | 0 | -2 | -1 | 0 | 0 | 0 |

| | | | | | | |
|---|---|---|---|---|---|---|
| 0 | 0 | 0 | 0 | 0 | -1 | -2 |
| 0 | 0 | 0 | 0 | -1 | -2 | 0 |
| 0 | 0 | 0 | -1 | -2 | 0 | 2 |
| 0 | 0 | -1 | -2 | 0 | 2 | 1 |
| 0 | -1 | -2 | 0 | 2 | 1 | 0 |
| -1 | -2 | 0 | 2 | 1 | 0 | 0 |
| -2 | 0 | 2 | 1 | 0 | 0 | 0 |

....CENTER VALUE (RATIO TO CENTER VALUE) 2 (1) .....CENTER VALUE (RATIO TO CENTER VALUE) -2 (1)
....3×3 BLOCK AVERAGE VALUE (RATIO TO CENTER VALUE) 0.67 (0.33) .....3×3 BLOCK AVERAGE VALUE (RATIO TO CENTER VALUE) -0.7 (0.33)
....5×5 BLOCK AVERAGE VALUE (RATIO TO CENTER VALUE) 0.24 (0.12) .....5×5 BLOCK AVERAGE VALUE (RATIO TO CENTER VALUE) -0.2 (0.12)
....7×7 BLOCK AVERAGE VALUE (RATIO TO CENTER VALUE) 0.12 (0.06) .....7×7 BLOCK AVERAGE VALUE (RATIO TO CENTER VALUE) -0.1 (0.06)

IMAGE F (IRREGULAR LINES)

| | | | | | | | | |
|---|---|---|---|---|---|---|---|---|
| 0 | 0 | 0 | 0 | 0 | 0 | 0 | 0 | 0 |
| 0 | 0 | 0 | 0 | 0 | 0 | 0 | 0 | 1 |
| 0 | 0 | 1 | 0 | 0 | 1 | 0 | 1 | 0 |
| 0 | 0 | 1 | 0 | 0 | 0 | 1 | 0 | 0 |
| 0 | 0 | 0 | 0 | 0 | 1 | 0 | 0 | 0 |
| 0 | 0 | 1 | 0 | 1 | 0 | 0 | 0 | 0 |
| 0 | 0 | 0 | 1 | 0 | 0 | 1 | 1 | 0 |
| 0 | 0 | 1 | 0 | 0 | 1 | 0 | 0 | 0 |
| 0 | 1 | 0 | 0 | 0 | 0 | 0 | 0 | 0 |

| | | | | | | |
|---|---|---|---|---|---|---|
| 1 | 0 | -1 | 1 | 0 | 0 | 2 |
| 3 | 0 | -3 | 2 | 1 | 0 | 0 |
| 3 | 0 | -3 | 2 | 2 | -1 | -2 |
| 2 | 0 | -1 | 2 | 0 | -2 | -1 |
| 2 | 1 | 0 | 0 | -1 | 0 | -1 |
| 2 | 2 | -1 | -1 | 1 | 1 | -2 |
| 2 | 0 | -2 | 1 | 1 | -1 | -1 |

| | | | | | | |
|---|---|---|---|---|---|---|
| -1 | -2 | -1 | -1 | -2 | -2 | -2 |
| -1 | -2 | -1 | 0 | -1 | -2 | 0 |
| 1 | 2 | 1 | 0 | 0 | 1 | 2 |
| 0 | 0 | -1 | -2 | 0 | 2 | 1 |
| 0 | -1 | -2 | 0 | 1 | -2 | -3 |
| 0 | 0 | 1 | 1 | -1 | -1 | 0 |
| -2 | 0 | 2 | 1 | 1 | 3 | 3 |

....CENTER VALUE (RATIO TO CENTER VALUE) 2 (1) .....CENTER VALUE (RATIO TO CENTER VALUE) -2 (1)
....3×3 BLOCK AVERAGE VALUE (RATIO TO CENTER VALUE) 0.11 (0.06) .....3×3 BLOCK AVERAGE VALUE (RATIO TO CENTER VALUE) -0.3 (0.17)
....5×5 BLOCK AVERAGE VALUE (RATIO TO CENTER VALUE) 0.04 (0.02) .....5×5 BLOCK AVERAGE VALUE (RATIO TO CENTER VALUE) -0.3 (0.14)
....7×7 BLOCK AVERAGE VALUE (RATIO TO CENTER VALUE) 0.2 (0.1) .....7×7 BLOCK AVERAGE VALUE (RATIO TO CENTER VALUE) -0.2 (0.1)

FIG. 17

IMAGE G (EDGE WITH INCLINATION OF 1/2)

| | | | | | | | | |
|---|---|---|---|---|---|---|---|---|
| 0 | 0 | 0 | 0 | 0 | 0 | 0 | 0 | 0 |
| 0 | 0 | 0 | 0 | 0 | 0 | 0 | 0 | 0 |
| 0 | 0 | 0 | 0 | 0 | 0 | 0 | 0 | 0 |
| 0 | 0 | 0 | 0 | 0 | 0 | 0 | 1 | 1 |
| 0 | 0 | 0 | 0 | 0 | 1 | 1 | 1 | 1 |
| 0 | 0 | 0 | 1 | 1 | 1 | 1 | 1 | 1 |
| 0 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |

| | | | | | | |
|---|---|---|---|---|---|---|
| 0 | 0 | 0 | 0 | 0 | 0 | 0 |
| 0 | 0 | 0 | 0 | 0 | 1 | 1 |
| 0 | 0 | 0 | 1 | 1 | 2 | 2 |
| 0 | 1 | 1 | 2 | 2 | 1 | 1 |
| 1 | 2 | 2 | 1 | 1 | 0 | 0 |
| 2 | 1 | 1 | 0 | 0 | 0 | 0 |
| 1 | 0 | 0 | 0 | 0 | 0 | 0 |

| | | | | | | |
|---|---|---|---|---|---|---|
| 0 | 0 | 0 | 0 | 0 | 0 | 0 |
| 0 | 0 | 0 | 0 | 0 | −1 | −3 |
| 0 | 0 | 0 | −1 | −3 | −4 | −4 |
| 0 | −1 | −3 | −4 | −4 | −3 | −1 |
| −3 | −4 | −4 | −3 | −1 | 0 | 0 |
| −4 | −3 | −1 | 0 | 0 | 0 | 0 |
| −1 | 0 | 0 | 0 | 0 | 0 | 0 |

CENTER VALUE (RATIO TO CENTER VALUE) 2 (1)
3×3 BLOCK AVERAGE VALUE (RATIO TO CENTER VALUE) 1.22 (0.67)
5×5 BLOCK AVERAGE VALUE (RATIO TO CENTER VALUE) 0.8 (0.4)
7×7 BLOCK AVERAGE VALUE (RATIO TO CENTER VALUE) 0.57 (0.29)

CENTER VALUE (RATIO TO CENTER VALUE) −4 (1)
3×3 BLOCK AVERAGE VALUE (RATIO TO CENTER VALUE) −2.6 (0.64)
5×5 BLOCK AVERAGE VALUE (RATIO TO CENTER VALUE) −1.6 (0.4)
7×7 BLOCK AVERAGE VALUE (RATIO TO CENTER VALUE) −1.1 (0.29)

IMAGE H (EDGE WITH INCLINATION OF 1)

| | | | | | | | | |
|---|---|---|---|---|---|---|---|---|
| 0 | 0 | 0 | 0 | 0 | 0 | 0 | 0 | 0 |
| 0 | 0 | 0 | 0 | 0 | 0 | 0 | 0 | 1 |
| 0 | 0 | 0 | 0 | 0 | 0 | 0 | 1 | 1 |
| 0 | 0 | 0 | 0 | 0 | 0 | 1 | 1 | 1 |
| 0 | 0 | 0 | 0 | 0 | 1 | 1 | 1 | 1 |
| 0 | 0 | 0 | 0 | 1 | 1 | 1 | 1 | 1 |
| 0 | 0 | 0 | 1 | 1 | 1 | 1 | 1 | 1 |
| 0 | 0 | 1 | 1 | 1 | 1 | 1 | 1 | 1 |
| 0 | 1 | 1 | 1 | 1 | 1 | 1 | 1 | 1 |

| | | | | | | |
|---|---|---|---|---|---|---|
| 0 | 0 | 0 | 0 | 0 | 1 | 3 |
| 0 | 0 | 0 | 0 | 1 | 3 | 3 |
| 0 | 0 | 0 | 1 | 3 | 3 | 1 |
| 0 | 0 | 1 | 3 | 3 | 1 | 0 |
| 0 | 1 | 3 | 3 | 1 | 0 | 0 |
| 1 | 3 | 3 | 1 | 0 | 0 | 0 |
| 3 | 3 | 1 | 0 | 0 | 0 | 0 |

| | | | | | | |
|---|---|---|---|---|---|---|
| 0 | 0 | 0 | 0 | 0 | −1 | −3 |
| 0 | 0 | 0 | 0 | −1 | −3 | −3 |
| 0 | 0 | 0 | −1 | −3 | −3 | −1 |
| 0 | 0 | −1 | −3 | −3 | −1 | 0 |
| 0 | −1 | −3 | −3 | −1 | 0 | 0 |
| −1 | −3 | −3 | −1 | 0 | 0 | 0 |
| −3 | −3 | −1 | 0 | 0 | 0 | 0 |

CENTER VALUE (RATIO TO CENTER VALUE) 3 (1)
3×3 BLOCK AVERAGE VALUE (RATIO TO CENTER VALUE) 2 (0.67)
5×5 BLOCK AVERAGE VALUE (RATIO TO CENTER VALUE) 1.36 (0.45)
7×7 BLOCK AVERAGE VALUE (RATIO TO CENTER VALUE) 1.02 (0.34)

CENTER VALUE (RATIO TO CENTER VALUE) −3 (1)
3×3 BLOCK AVERAGE VALUE (RATIO TO CENTER VALUE) −2 (0.67)
5×5 BLOCK AVERAGE VALUE (RATIO TO CENTER VALUE) −1.4 (0.45)
7×7 BLOCK AVERAGE VALUE (RATIO TO CENTER VALUE) −1 (0.34)

IMAGE I (EDGE WITH INCLINATION OF 2)

| | | | | | | | | |
|---|---|---|---|---|---|---|---|---|
| 0 | 0 | 0 | 0 | 0 | 0 | 0 | 1 | 1 |
| 0 | 0 | 0 | 0 | 0 | 0 | 1 | 1 | 1 |
| 0 | 0 | 0 | 0 | 0 | 0 | 1 | 1 | 1 |
| 0 | 0 | 0 | 0 | 0 | 1 | 1 | 1 | 1 |
| 0 | 0 | 0 | 0 | 0 | 1 | 1 | 1 | 1 |
| 0 | 0 | 0 | 0 | 1 | 1 | 1 | 1 | 1 |
| 0 | 0 | 0 | 0 | 1 | 1 | 1 | 1 | 1 |
| 0 | 0 | 0 | 1 | 1 | 1 | 1 | 1 | 1 |
| 0 | 0 | 0 | 1 | 1 | 1 | 1 | 1 | 1 |

| | | | | | | |
|---|---|---|---|---|---|---|
| 0 | 0 | 0 | 0 | 3 | 4 | 1 |
| 0 | 0 | 0 | 1 | 4 | 3 | 0 |
| 0 | 0 | 0 | 3 | 4 | 1 | 0 |
| 0 | 0 | 1 | 4 | 3 | 0 | 0 |
| 0 | 0 | 3 | 4 | 1 | 0 | 0 |
| 0 | 1 | 4 | 3 | 0 | 0 | 0 |
| 0 | 3 | 4 | 1 | 0 | 0 | 0 |

| | | | | | | |
|---|---|---|---|---|---|---|
| 0 | 0 | 0 | 0 | −1 | −2 | −1 |
| 0 | 0 | 0 | −1 | −2 | −1 | 0 |
| 0 | 0 | 0 | −1 | −2 | −1 | 0 |
| 0 | 0 | −1 | −2 | −1 | 0 | 0 |
| 0 | 0 | −1 | −2 | −1 | 0 | 0 |
| 0 | −1 | −2 | −1 | 0 | 0 | 0 |
| 0 | −1 | −2 | −1 | 0 | 0 | 0 |

CENTER VALUE (RATIO TO CENTER VALUE) 4 (1)
3×3 BLOCK AVERAGE VALUE (RATIO TO CENTER VALUE) 2.56 (0.64)
5×5 BLOCK AVERAGE VALUE (RATIO TO CENTER VALUE) 1.6 (0.4)
7×7 BLOCK AVERAGE VALUE (RATIO TO CENTER VALUE) 1.14 (0.29)

CENTER VALUE (RATIO TO CENTER VALUE) −2 (1)
3×3 BLOCK AVERAGE VALUE (RATIO TO CENTER VALUE) −1.2 (0.61)
5×5 BLOCK AVERAGE VALUE (RATIO TO CENTER VALUE) −0.8 (0.4)
7×7 BLOCK AVERAGE VALUE (RATIO TO CENTER VALUE) −0.6 (0.29)

CONTROL DEVICE FOR LIQUID CRYSTAL DISPLAY DEVICE, LIQUID CRYSTAL DISPLAY DEVICE, METHOD FOR CONTROLLING LIQUID CRYSTAL DISPLAY DEVICE, PROGRAM, AND STORAGE MEDIUM FOR PROGRAM

TECHNICAL FIELD

The present invention relates to a liquid crystal display device in which display states of a plurality of display areas are controlled based on a plural pieces of divided image data, which is obtained by dividing image data for a single screen into the plural pieces of divided image data for respective ones of the plurality of display areas of a liquid crystal display panel.

BACKGROUND ART

Conventionally, various kinds of techniques have been proposed in which backlights are provided for respective ones of a plurality of display areas in a display screen of a liquid crystal display panel, and luminances of the backlights are controlled in accordance with respective pieces of image data to be displayed in the plurality of display areas.

For example, Patent Literature 1 discloses a technique in which image data is divided for a plurality of video areas for which backlights are respectively provided, and luminances of the backlights are controlled in accordance with respective APLs (average luminance) of the plurality of video areas.

Moreover, Patent Literature 2 discloses a technique for compensating display image data in accordance with a brightness distribution of a backlight.

Patent Literature 1

Japanese Patent Publication, No. 3766231 (Publication Date: Nov. 24, 2000)

Patent Literature 2

Japanese Patent Application Publication, Tokukai, No. 2005-309338 (Publication Date: Nov. 4, 2005)

SUMMARY OF INVENTION

In a case of, for example, a display device which displays an image of 4K2K class (which is a high-resolution image of approximately horizontal 4000 pixels×vertical 2000 pixels, such as 3840×2160 dots, 4096×2160 dots, 4096×1776 dots, or 3300×2160 dots), (i) display image data for a single screen is divided into plural pieces of image data for a plurality of areas of a display screen, due to restrictions of a memory, a circuit size of an LSI, and the like, and (ii) images to be displayed in the respective ones of the plurality of areas are controlled in accordance with the plural pieces of divided image data.

However, in a case where (i) a liquid crystal display device includes a plurality of light sources provided as backlights on a backside of a liquid crystal display panel and (ii) a display is carried out with the use of display image data for a single screen which is divided into a plural pieces of image data for a plurality of areas, there is a problem that a luminance distribution in a border area of the divided images cannot be controlled properly, when luminances of the plurality of light sources are controlled in accordance with the plural pieces of divided image data.

Luminance distributions of respective ones of the plurality of light sources spread and thereby overlap each other. Accordingly, a luminance distribution in the liquid crystal display panel is defined by the luminance distributions of the respective ones of the plurality of light sources. Therefore, for example, in a case where brightness of an image to be displayed in a border area of divided images is changing, luminance of one of divided image areas cannot be controlled properly when luminance of a backlight corresponding to an adjacent divided image area is controlled in accordance with only image data of the adjacent divided image area.

The present invention is accomplished in view of the problem, and an object of the present invention is to improve display quality in a border area of each of a plurality of areas in a display screen of a backlight-provided liquid crystal display device, in a case where display image data for a single screen is divided into a plural pieces of divided image data for respective ones of the plurality of areas and respective images to be displayed in the plurality of areas are controlled in accordance with the plural pieces of divided image data.

In order to attain the object, a control device of the present invention for a liquid crystal display device which includes a liquid crystal display panel and a backlight unit having a plurality of light sources arranged in a matrix manner in a backside of the liquid crystal display panel, the control device including: a liquid crystal control section which controls pixels of the liquid crystal display panel in accordance with a plural pieces of divided image data, the plural pieces of divided image data being prepared by dividing image data for a single screen into pieces for respective ones of a plurality of display areas of the liquid crystal display panel; and a backlight control section which controls light-emitting states of respective ones of the plurality of light sources in accordance with undivided image data for a single screen.

According to the configuration, in the liquid crystal display panel, the liquid crystal control section controls display states of respective ones of the plurality of display areas based on the plural pieces of divided image data which have been prepared by dividing image data for a single screen into a plural pieces for respective ones of the plurality of display areas of the liquid crystal display panel. In the backlight unit, the backlight control section controls light-emitting states of respective ones of the plurality of light sources based on the undivided image data for a single screen. With the configuration, even in a case where image data used for driving the liquid crystal display panel is a plural pieces of divided image data, the light sources in the border areas of the respective display areas can be controlled properly. This makes it possible to prevent decrease of display quality in the border areas of the respective display areas.

It is possible that the backlight control section includes a light source luminance setting section which determines the light-emitting luminances of the respective ones of the plurality of light sources in accordance with the undivided image data for the single screen, a light source driving section which causes the plurality of light sources to emit light in accordance with the respective light-emitting luminances determined by the light source luminance setting section, and a luminance distribution data generating section which generates luminance distribution data indicative of luminance distribution caused in the liquid crystal display panel due to light emitted by the plurality of light sources, the plurality of light sources emitting the light according to the respective light-emitting luminances determined by the light source luminance setting section; and the liquid crystal control section includes a compensating section which compensates the plural pieces of divided image data in accordance with the luminance distribution data, and a liquid crystal driving section which drives the pixels of the liquid crystal display panel in accordance with the plural pieces of divided image data compensated by the compensating section.

According to the configuration, the luminance distribution data generating section generates luminance distribution data in the liquid crystal display panel in accordance with light-emitting states of the respective ones of the plurality light sources, and, based on the luminance distribution data, the compensating section compensates image data of an image to be displayed on the liquid crystal display panel. This makes it possible to properly control a luminance distribution of a displayed image which is to be seen by the user.

The control device can further include: an image size adjusting section which adjusts an image size of inputted image data for a single screen in a case where an aspect ratio of the inputted image data is different from an aspect ratio of the liquid crystal display panel, the image size adjusting section adding dummy image data to a periphery of the inputted image data so as to adjust the image size of inputted image data, so that the aspect ratio of the inputted image data conforms to the aspect ratio of the liquid crystal display panel, the light source luminance setting section determining the light-emitting luminances of the respective ones of the plurality of light sources in accordance with image data whose image size has been adjusted by the image size adjusting section.

According to the configuration, even in a case where the aspect ratio of the inputted image data for a single screen is different from the aspect ratio of the liquid crystal display panel, light-emitting states of the respective ones of the plurality of light sources can be controlled properly in accordance with an image to be displayed on the liquid crystal display panel.

It is possible that the light source luminance setting section divides image data for a single screen into a plurality of blocks which correspond to respective positions in which the plurality of light sources are provided, determines a light-emitting luminance of each light source in an image display area among the plurality of light sources in accordance with a maximum value among gradation values of pixels included in that one of the plurality of blocks corresponding to the light source, the image display area being an area for displaying an image corresponding to the inputted image data, and determines a light-emitting luminance of each light source in an image non-display area among the plurality of light sources in accordance with (i) an average luminance level of pixels included in a block of an image display area adjacent to a block corresponding to the light source, the image non-display area being an area in which an image corresponding to the dummy image data is displayed, or (ii) an average luminance level of some of a plurality of small blocks which are adjacent to the image non-display area, the plurality of small blocks being obtained by further dividing the block of the image display area adjacent to the block corresponding to the light source.

According to the configuration, the light-emitting luminances of light sources corresponding to the image non-display area can be controlled based on the average luminance level calculated from image data in an edge area of an image display area adjacent to the image non-display area. Accordingly, it is possible to prevent decrease of display quality in the edge area of the image display area.

The control device can further include: a first dividing section which divides inputted image data for a single screen into a plural pieces of divided image data, the inputted image data having a resolution which is a predetermined resolution or more; and a down-converting section which converts the resolution of the inputted image data into a resolution lower than originally inputted resolution of the inputted image data, the light source luminance setting section determining the light-emitting luminances of the respective ones the plurality of light sources in accordance with the image data whose resolution has been lowered by the down-converting section, and in accordance with the luminance distribution data, the compensating section compensating the plural pieces of divided image data prepared by the first dividing section.

According to the configuration, in a case where image data for a single screen having a predetermined resolution or more is inputted, the inputted image data is divided into a plural pieces of divided image data, and a display state of the liquid crystal display panel is controlled based on the plural pieces of divided image data. Accordingly, even in a case where an image size of the image data for a single screen is large, the display state of the liquid crystal display panel can be controlled properly. For example, even in a case where it is difficult to totally process image data for a single screen because of restrictions, etc. of memory and a circuit size of LSI as in image data of 4K2K class, an operation of the liquid crystal display panel can be controlled properly based on the plural pieces of divided image data. Moreover, in the backlight unit, light-emitting states of respective ones of the plurality of light sources can be controlled based on image data for a single screen which has been down-converted by the down-converting section. This makes it possible to prevent decrease of display quality in the border area of the plurality of display areas. Note that, in general, the number of the plurality of light sources arranged in a matrix manner in the backlight unit is far fewer than the number of pixels of the liquid crystal display panel. Therefore, even in a case where the light-emitting states of the respective ones of the plurality of light sources are controlled based on the down-converted image data, the light-emitting states of the respective ones of the plurality of light sources can be controlled properly.

The control device can further include: an image restoring section which (i) receives a plural pieces of divided image data which have been prepared by dividing the image data for a single screen, the image data for the single screen having a resolution which is equal or greater than a predetermined resolution, and (ii) restores the image data for the single screen by combining the plural pieces of divided image data; and a down-converting section which converts the resolution of the image data thus restored into a resolution lower than the resolution of the image data thus restored, the light source luminance setting section determining the light-emitting luminances of the respective ones of the plurality of light sources in accordance with the image data whose resolution has been lowered by the down-converting section, and in accordance with the luminance distribution data, the compensating section compensating the plural pieces of divided image data.

According to the configuration, the display state of the liquid crystal display panel is controlled based on the plural pieces of divided image data. Accordingly, even in a case where image data for a single screen which image data is not divided yet has a large image size, the display state of the liquid crystal display panel can be controlled properly. Moreover, in the backlight unit, light-emitting states of respective ones of the plurality of light sources can be controlled based on the image data for a single screen which has been down-converted by the down-converting section. This makes it possible to prevent decrease of display quality in the border area of the plurality of display areas.

The control device can further include: a second dividing section which divides inputted image data for a single screen into a plural pieces of divided image data, the inputted image data having a resolution less than a predetermined resolution; and an upscaling process section which enhances resolutions of the plural pieces of divided image data so that the resolutions become higher than the resolutions of the plural pieces of divided image data, the plural pieces of divided image data having been prepared by the second dividing section, the light source luminance setting section determining the light-emitting luminances of the respective ones of the plurality of light sources in accordance with the inputted image data for the single screen, and in accordance with the luminance distribution data, the compensating section compensating the plural pieces of divided image data whose resolutions have been enhanced by the upscaling process section.

According to the configuration, in a case where image data for a single screen having a resolution which is less than a predetermined resolution is inputted, the inputted data is divided into a plural pieces of divided image data and the plural pieces of divided image data are converted so as to respectively have high resolutions. A display state of the liquid crystal display panel is controlled based on the image data thus converted. This makes it possible to display an image corresponding to the inputted image data while using the display screen of the liquid crystal display panel more effectively. Moreover, in the backlight unit, light-emitting states of the plurality of light sources are controlled based on the inputted image data for a single screen. This makes it possible to prevent decrease of display quality in the border area of the plurality of display areas.

It is possible that the second dividing section generates the plural pieces of divided image data so that each one of the plural pieces of divided image data shares a portion with its adjacent one of the plural pieces of divided image data, so that border areas of that one and its adjacent one of the plural pieces of divided image data overlap each other, the upscaling process section includes a difference operation section which carries out a difference operation process in which a gradation value of a target pixel is calculated by an operation with use of differentiation or difference of gradation values in vicinity to the target pixel, the gradation value of the target pixel being used for extracting an edge of an article pictured in an image, an averaging process section which carries out an averaging process in which an average value of the gradation values in vicinity to the target pixel is calculated as a gradation value of the target pixel, a correlation operation section which carries out calculation process for obtaining a correlation value indicative of a correlation between difference image data and averaged image data, the difference image data being produced by subjecting the plural pieces of divided image data to the difference operation process, and the averaged image data being produced by subjecting the plural pieces of divided image data to the difference operation process and the averaging process; and an interpolation process section which carries out an interpolation process on the plural pieces of divided image data with use of an interpolation method which is selected in accordance with the correlation value.

According to the configuration, the correlation value is used for appropriately judging whether a vicinity to the target pixel is an edge part or non-edge part. That is, in the non-edge part, noise and thin lines, etc., other than the edge are eliminated through the averaging process, and accordingly the correlation value becomes small. On the other hand, the edge part does not change so much through the averaging process, whereby the correlation value becomes large. Therefore, with the use of the correlation value, it is possible to appropriately judge whether the vicinity of the target pixel is an edge part or a non-edge part. Moreover, according to the configuration, the interpolation process section carries out interpolation process on the plural pieces of divided image data with an interpolation method selected in accordance with the correlation value, and accordingly the plural pieces of divided image data are upscaled. This makes it possible to carry out respective different interpolation processes on the edge part and the non-edge part. Accordingly, a high-resolution image can be produced. Each of the plural pieces of divided image data only needs to include gradation values in vicinity to each target pixel to be referred to in the difference operation process. Accordingly, it is not necessary to check the whole image for edge detection. This makes it possible to (i) use a small image data for the edge detection process, (ii) reduce a circuit size, and (iii) reduce processing time.

The liquid crystal display device of the present invention includes: a liquid crystal display panel; a backlight unit having a plurality of light sources arranged in a matrix manner in a backside of the liquid crystal display panel; and any one of control devices described above.

According to the configuration, the light sources in the border area of the plurality of display areas can be controlled properly. Accordingly, it is possible to prevent decrease of display quality in the border area of the plurality of display areas.

A method, of the present invention, for controlling a liquid crystal display device which includes a liquid crystal display panel and a backlight unit having a plurality of light sources arranged in a matrix manner in a backside of the liquid crystal display panel, said method comprising the steps of: controlling display states of a plurality of display areas in accordance with a plural pieces of divided image data, the plural pieces of divided image data being prepared by dividing image data for a single screen into pieces for respective ones of the plurality of display areas of the liquid crystal display panel; and controlling light-emitting states of respective ones of the plurality of light sources in accordance with undivided image data for a single screen.

According to the method, in the liquid crystal display panel, display states of respective ones of the plurality of display areas are controlled based on the plural pieces of divided image data which are prepared by dividing image data for a single screen into a plural pieces for respective ones of the plurality of display areas of the liquid crystal display panel. In the backlight unit, light-emitting states of respective ones of the plurality of light sources are controlled based on the undivided image data for a single screen. With the configuration, even in a case where image data used for driving the liquid crystal display panel is a plural pieces of divided image data, the light sources in the border areas of the display areas can be controlled properly. This makes it possible to prevent decrease of display quality in the border areas of the display areas.

Note that the control device can be realized by a computer. In that case, the computer is caused to serve as the sections described above. Accordingly, (i) a program for causing the computer to serve as the control device and (ii) a computer-readable storage medium storing the program are encompassed in the invention.

BRIEF DESCRIPTION OF DRAWINGS

FIG. 14 is an explanatory view illustrating an overview of a difference operation process carried out in the liquid crystal display device shown in FIG. 1.

FIG. 15 is a chart illustrating an example of results of a difference operation process carried out in the liquid crystal display device shown in FIG. 1.

FIG. 16 is a chart illustrating an example of results of a difference operation process carried out in the liquid crystal display device shown in FIG. 1.

FIG. 17 is a chart illustrating an example of results of a difference operation process carried out in the liquid crystal display device shown in FIG. 1.

REFERENCE SIGNS LIST

Figure 1:
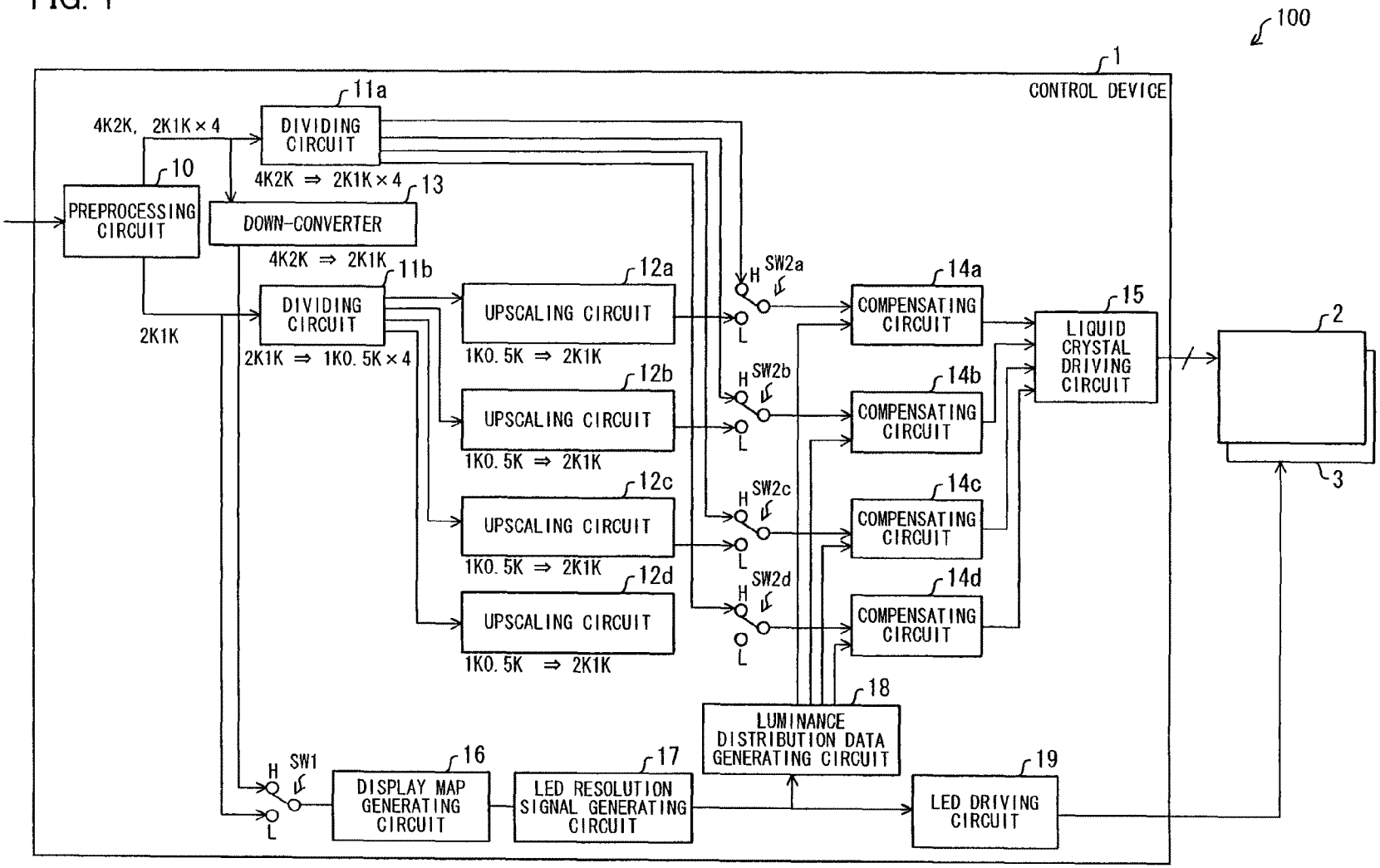
FIG. 1 is a block diagram schematically illustrating a structure of a liquid crystal display device, according to an embodiment of the present invention.

1: Control device
2: Liquid crystal display panel
3: Backlight unit
10: Preprocessing circuit (image size adjusting section, image restoring section)
11*a*: Dividing circuit (liquid crystal control section, first dividing section)
11*b*: Dividing circuit (liquid crystal control section, second dividing section)
12*a* through 12*d*: Upscaling circuit (liquid crystal control section, upscaling section)
13: Down-converter (liquid crystal control section, down-converting section)
14*a* through 14*d*: Compensating circuit (liquid crystal control section, compensating section)
15: Liquid crystal driving circuit (liquid crystal control section, liquid crystal driving section)
16: Display map generating circuit (backlight control section)
17: LED resolution signal generating circuit (backlight control section, LED luminance setting section)
18: Luminance distribution data generating circuit (backlight control section, luminance distribution data generating section)
19: LED driving circuit (backlight control section, LED driving section)
21: Edge detection circuit
22: Interpolation circuit (interpolation process section)
31: Difference circuit (difference operation section)
32: Filter rotation circuit
33: Direction setting circuit
34: Averaging circuit (averaging process section)
35: Correlation operation circuit (correlation operation section)
36: Edge-distinguishing circuit
100: Liquid crystal display device

DESCRIPTION OF EMBODIMENTS

The following describes an embodiment of the present invention.

(1-1. Configuration of Liquid Crystal Display Device 100)

FIG. 1 is a block diagram schematically illustrating a structure of a liquid crystal display device 100 of the present embodiment. As shown in FIG. 1, the liquid crystal display device 100 includes a control device 1, a liquid crystal display panel 2, and a backlight unit 3.

The liquid crystal display panel 2 displays an image corresponding to image data. In the present embodiment, a panel having a display size of 4096×2160 dots is used. However, the liquid crystal panel 2 is not limited to this, but conventionally known various liquid crystal display panels can be used.

The backlight unit 3 is provided on a backside, with respect to a display face, of the liquid crystal display panel 2 and emits light so that the liquid crystal display panel 2 can display an image. The backlight unit 3 includes a plurality of LEDs (light sources) as light sources. In the present embodiment, a backlight unit is used which includes LEDs as light sources arranged in a matrix pattern of 8×4. However, the number of the LEDs is not limited to this. For example, more of the LEDs can be provided. Moreover, the present embodiment discusses a case where the LEDs are used as the light sources. However, the light sources of the present invention are not limited to this but another light emitting elements such as, for example, EL (Electro-Luminescence) elements can be used as the light sources. Moreover, the present embodiment discusses a configuration in which the LEDs (light sources) are provided directly under the liquid crystal display panel without providing a light guide plate between the LEDs and the liquid crystal display panel (so-called direct illumination device). However, the present invention is not limited to this. It is possible to use a illumination device of another type such as, for example, (i) an edge-lighting illumination device in which a single light guide panel is provided below a light-emitting face of the illuminating device and a plurality of light source substrates are provided on at least one of four sides surrounding the light guide panel so that the plurality of light source substrates are arranged in parallel with the at least ones of four sides, or (ii) another type of illuminating device such as a tandem illuminating device in which light guide plates are provided for respective light-emitting elements.

The control device 1 includes a preprocessing circuit 10, dividing circuits 11*a* and 11*b*, upscaling circuits 12*a* through 12*d*, a down-converter 13, compensating circuits 14*a* through 14*d*, a liquid crystal driving circuit 15, a display map generating circuit 16, an LED resolution signal generating circuit 17, a luminance distribution data generating circuit 18, an LED driving circuit 19, and switches SW1, SW2*a* through SW2*d*.

In a case where an aspect ratio of the inputted image data is different from that of the liquid crystal display panel 2, the preprocessing circuit (image size adjusting section, image restoring section) 10 carries out an adjusting process for conforming the aspect ratio of the inputted image data to that of the liquid crystal display panel 2 by, for example, adding dummy image data (e.g., black pixels) to the inputted image data. For example, in a case where image data having an image size of 3840×2160 dots is inputted to the control device 1, the transversal size (3840 dots) is smaller than the display screen size (4096 dots) of the liquid crystal display panel 2 which has the display screen size of 4096×2160. In this case, an image in a left half of divided areas needs to be shifted toward right by 2048−1920=128 dots in displaying the image. Therefore, the preprocessing circuit 10 adds dummy image data on each of a right side and a left side of the inputted image data so that the image corresponding to the inputted image data is disposed in a position which is shifted toward right by 128 dots from a left end of the display screen of the liquid crystal display panel 2.

Moreover, in a case where the inputted image data is image data of 4K2K class, the preprocessing circuit 10 supplies image data, which has been adjusted, to the dividing circuit 11*a* and the down-converter 13. Alternatively, in a case where the inputted image data is image data of 2K1K class or less, the preprocessing circuit 10 supplies image data, which has been adjusted, to the dividing circuit 11*b* and the display map generating circuit 16.

Note that, in a case where image data inputted to the control device 1 is a plural pieces of divided image data which is prepared by dividing original image data for a single screen (image data of 4K2K class) into the plural pieces for respective display areas, the preprocessing circuit 10 carries out the above-described adjusting process on the plural pieces of divided image data and supplies, to the dividing circuit 11*a*, the plural pieces of divided image data thus adjusted, and also supplies, to the down-converter 13, image data which is obtained by combining the plural pieces of divided image data thus adjusted. In this case, the dividing circuit 11*a* is to supply, to the compensating circuits 14*a* through 14*d*, the respective ones of the plural pieces of the divided image data sent from the preprocessing circuit 10.

Figure 2:
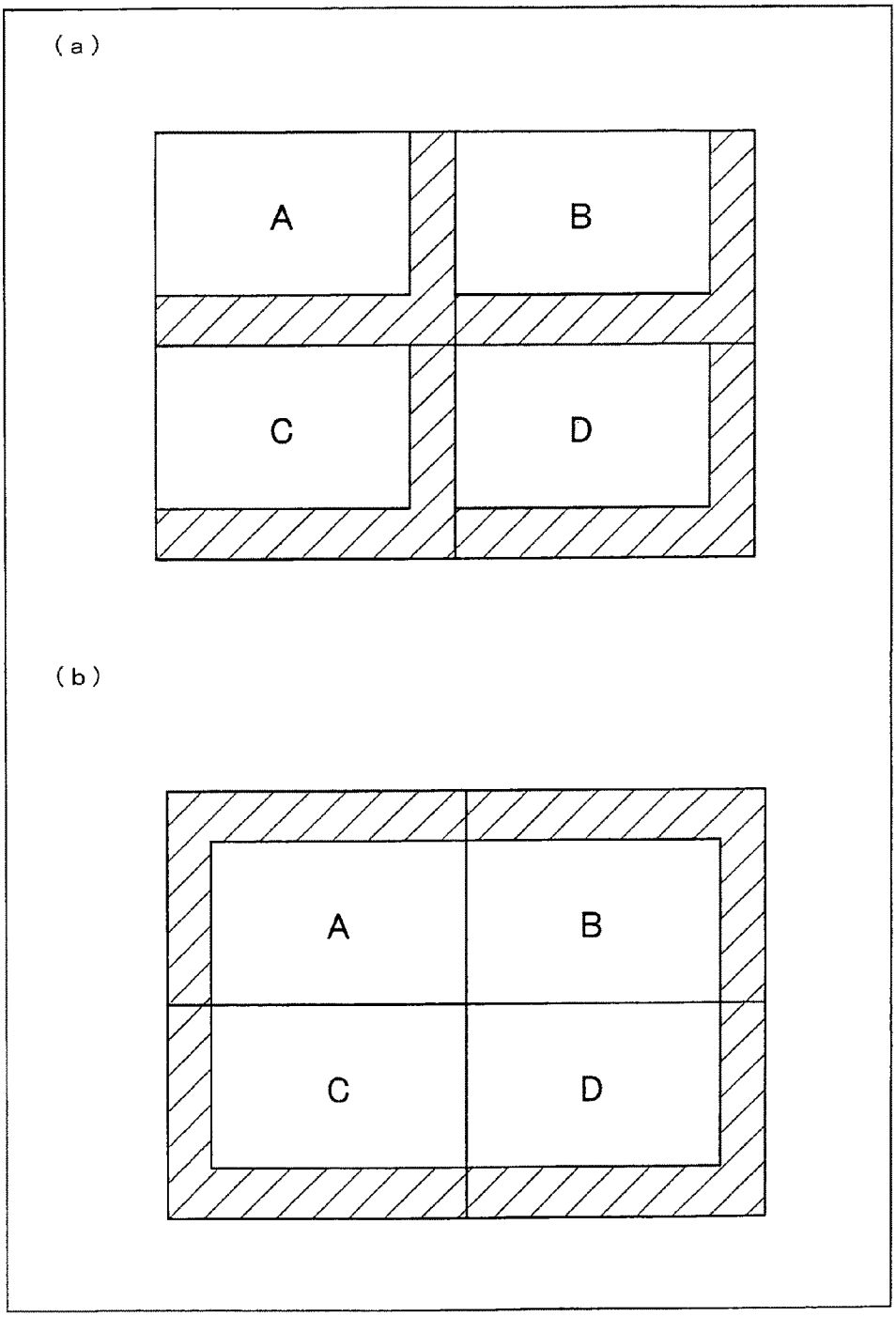
FIG. 2 (a) and (b) of FIG. 2 are explanatory views illustrating examples of methods for combining a plural pieces of divided image data.

In order to prevent (i) a non-display area from occurring between the plural pieces of divided image data and (ii) disposition of display positions of the plural pieces of divided image data, the preprocessing circuit 10 sets, for each of the plural pieces of divided image data, a position of dummy image data to be added to each of the plural pieces of divided image data, when the above-described adjusting process is carried out on the plural pieces of divided image data. For example, as shown in (a) of FIG. 2, in a case where dummy image data is uniformly added to right and lower sides of each of the plural pieces of divided image data, non-display areas occur between the plural pieces of divided image data. In order to prevent (i) such non-display areas from occurring between the plural pieces of divided image data and (ii) disposition of display positions of the plural pieces of divided image data, the dividing circuit 11*a* controls, for each of the areas, the position of the dummy image data to be added (see (b) of FIG. 2).

In a case where image data for a single screen is inputted to the control device 1 and an aspect ration of the inputted image data is different from an aspect ratio of the liquid crystal display panel 2, the preprocessing circuit 10 adds dummy image data (e.g., black pixels) to a periphery of an image corresponding to the inputted image data so that the inputted image data will be displayed in the center of the display screen of the liquid crystal display panel 2.

Note that, with regard to an aspect ratio (image size) of image data, a horizontal size, for example, can be detected by counting, after a horizontal sync signal is inputted, the number of clock signals during a period in which a data-enabling signal is at a high-level. Moreover, a vertical size can be detected by counting, after a vertical sync signal is inputted, the number of times that a data-enabling signal is switched from a low-level to a high-level.

In a case where image data supplied from the preprocessing circuit 10 is a video signal H of 4K2K class (resolution of approximately 4000×2000 dots), the dividing circuit (first dividing section) 11*a* divides the video signal H into a plural pieces of image data for each of a predetermined number (four in the present embodiment) of display areas, and sends the plural pieces of divided image data to the compensating circuits 14*a* through 14*d* via the switches SW2*a* through SW2*d*, respectively. For example, in a case where image data of 3840×2160 dots is supplied, as the video signal H of 4K2K class, to the dividing circuit 11*a*, the dividing circuit 11*a* divides the image data into four pieces of image data for four areas (upper left, upper right, lower left, and lower right; each piece of image data has an image size of 1920×1080 dots). However, the number of divided images and arrangement of the divided areas are not limited to this. For example, the inputted data can be divided so that the divided areas align either in a horizontal direction or in a vertical direction. A dividing method can be selected in accordance with a characteristic of the dividing method, and a circuit technology and a liquid crystal panel technology at a point in time when the dividing method is used, etc. In the case of the present embodiment where the inputted data is divided into the four pieces of image data for the areas of upper left, upper right, lower left, and lower right, each image data of the divided area is of 2K1K. Accordingly, it is possible to use a driving method without modification which method is used in a conventional display device of 2K1K class. Moreover, a conventional signal processing circuit (signal processing LSI) which is used in a 2K1K class can be used. This provides advantageous effects of reducing manufacturing cost and development cost.

In a case where a plural pieces of divided image data, which are prepared by dividing original image data for a single screen, are supplied from the preprocessing circuit 10 to the dividing circuit 11*a*, the dividing circuit 11*a* sends the plural pieces of divided image data to the compensating circuits 14*a* through 14*d* via the switches SW2*a* through SW2*d*, respectively.

In a case where image data supplied to the control device 1 is the video signal H of 4K2K class or the plural pieces of divided image data prepared from image data of 4K2K class, a control section (not illustrated) causes the switches SW2*a* through SW2*d* to connect the dividing circuit 11*a* to the compensating circuits 14*a* through 14*d*, respectively. In a case where the image data supplied to the control device 1 is a video signal L of 2K1K class (resolution of approximately 2000×1000 dots) or less, the control section causes the switches SW2*a* through SW2*d* to connect the upscaling circuits 12*a* through 12*d* to the compensating circuits 14*a* through 14*d*, respectively.

In a case where a video signal H of 4K2K class is supplied to the control device 1, the down-converter (down-converting section) 13 down-converts the video signal H into image data of 2K1K class (in the present embodiment, 1920×1080 dots), and sends the image data to the display map generating circuit 16 via the switch SW1. A method for down-converting is not limited in particular. For example, an average value of four pixels in an inputted image signal can be set as a value for a single pixel in an output image signal which single pixel is in a position corresponding to the four pixels.

In a case where image data supplied to the control device 1 is a video signal H of 4K2K class or a plural pieces of divided image data prepared from image data of 4K2K class, the control section (not illustrated) switches the switch SW1 so that a video signal, which is outputted from the down-converter 13, is supplied to the display map generating section 16. In a case where image data supplied to the control device 1 is a video signal L of 2K1K class, the control section switches the switch SW1 so that the video signal L is supplied to the display map generating section 16.

The dividing circuit (second dividing section) 11*b* divides a video signal L of 2K1K class which has been supplied to the control device 1 into pieces of image data for a predetermined number of areas, and sends the plural pieces of divided image data to the respective upscaling circuits 12*a* through 12*d*. Note that the present embodiment discusses a case where a high-definition data of 2K1K class is inputted as the video signal L and the high-definition data is divided into pieces of image data for four areas (upper left, upper right, lower left, and lower light). However, the number of divided images and arrangement of the divided areas are not limited to this.

Each of the upscaling circuits (upscaling sections) 12*a* through 12*d* receives a corresponding piece of image data divided by the dividing circuit 11*b*, and carry out an upscaling process on the corresponding piece of image data thus received. Then, the upscaling circuits 12*a* through 12*d* send the pieces of image data, which have been upscaled, to the compensating circuits 14*a* through 14*d* via the switches SW2*a* through SW2*d*, respectively. Note that details of the dividing process and the upscaling process of image data are described later.

The compensating circuits (compensating sections) 14*a* through 14*d* compensate image data in accordance with luminance distribution data supplied from the luminance distribution data generating circuit 18 which is described later, and send the compensated image data to the liquid crystal driving circuit 15. In an LED backlight system in which a plurality of LEDs are provided on a backside of a liquid crystal display panel, each of the LEDs shows a luminance distribution in which a luminance at a position immediately above the LED is high and the luminance becomes lower as a distance from the LED increases. Moreover, a luminance distribution, which is caused by the LED backlight, in areas of the liquid crystal display panel 2 includes luminance distributions, which overlap each other, of the respective LEDs. In accordance with the luminance distribution data supplied from the luminance distribution data generating circuit 18, the compensating circuits 14*a* through 14*d* compensate image data so that (i) transmittance of liquid crystal becomes low in a position immediately above the LED and (ii) the transmittance becomes higher as a distance from the position increases.

Figure 3:
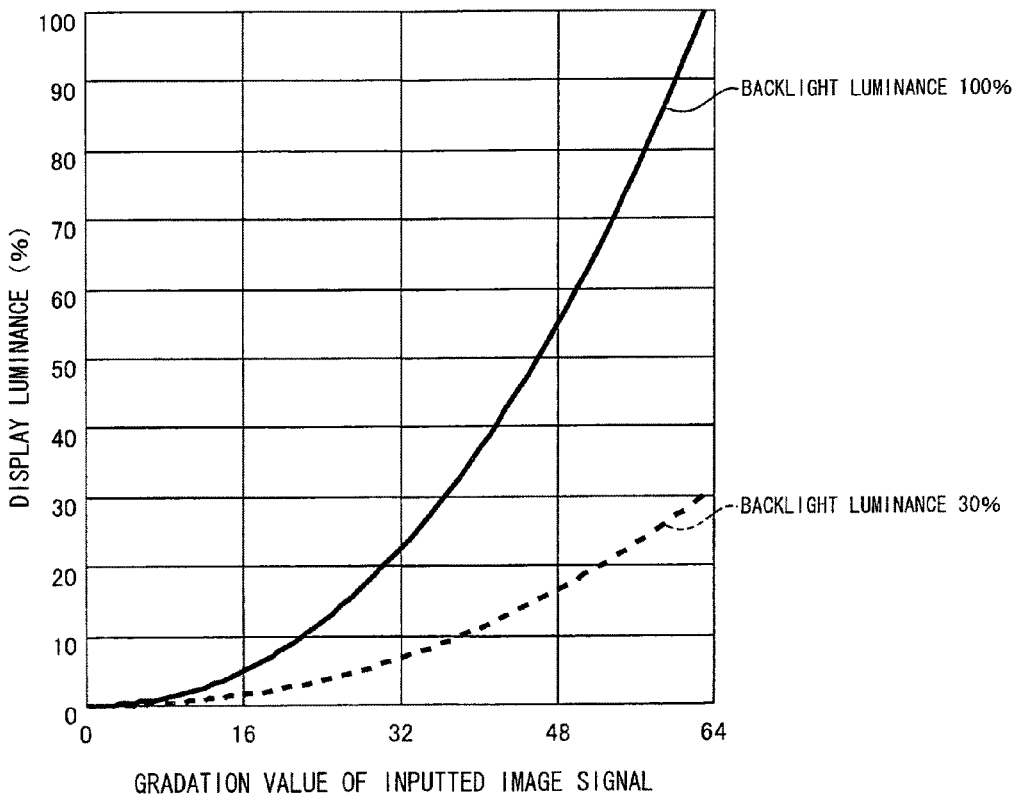
FIG. 3 is a graph illustrating a relation between gradation values of an inputted image signal and gradation values of a display image in a case where luminance of a backlight is varied.

FIG. 3 is a graph illustrating a relation between gradation values of an inputted image signal and a luminance of a display image in a target pixel in a case where a liquid crystal display panel is used whose input tones are 64 (0 through 63) tones and a tone-luminance characteristic is γ 2.2. A solid line indicates a case where a luminance of light which is emitted from the backlight toward the target pixel is 100%, and a dotted line indicates a case where a luminance of light emitted from the backlight toward the target pixel is 30%. According to the example shown in FIG. 3, a gradation value of an inputted image signal is 20, and when the luminance of the backlight is 100%, a luminance of the display image is approximately 8%. On the other hand, as shown in FIG. 3, when the luminance of the backlight is 30%, the luminance of the display image is to be decreased to approximately 2.4%. Therefore, in order to display the image without changing its luminance, the gradation value of the inputted image signal needs to be compensated in accordance with the luminance of the backlight. Specifically, in a case where the luminance of the backlight is 100%, the gradation value of the inputted image signal needs to be compensated to a gradation value (34.5), with which a display image having a luminance (approximately 26.7%) can be obtained. The luminance of approximately 26.7% is a value which is obtained by dividing, by the luminance of the backlight (30%), the luminance (approximately 8%) of the display image when the luminance of the backlight is 100%. More specifically, it is necessary to compensate the gradation value of the image signal so that the compensated gradation value becomes: $((\text{inputted gradation value}/63)^{2.2}/\text{backlight luminance})^{(1/2.2)}\times 63$.

Figure 4:
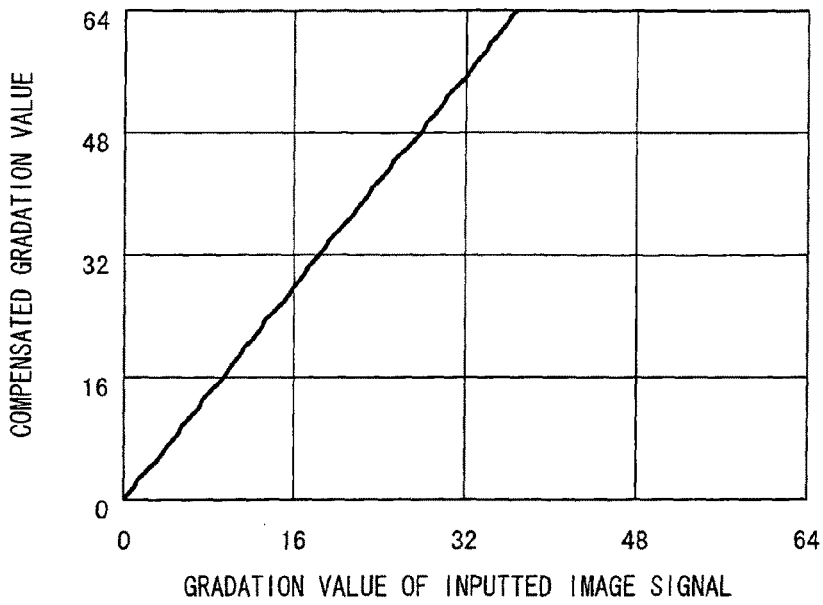
FIG. 4 is a graph illustrating a relation between gradation values of an inputted image signal and compensated gradation values, in order to prevent gradation of a display image from being varied even in a case where luminance of a backlight is varied.

FIG. 4 is a graph illustrating a relation between gradation values of an inputted image signal and compensated gradation values in a case where input tones are 64 (0 through 63) tones, a tone-luminance characteristic of the liquid crystal display panel is γ 2.2, and a luminance of the backlight is set to 30%. As shown in FIG. 4, even when the luminance of the backlight is 30%, the image can be displayed without changing its luminance when the gradation values 0 through 32 of the inputted image signal are compensated to (converted into) gradation values 0 through 55. Moreover, with the configuration, a display luminance in displaying a black image can be decreased and contrast can be increased. Moreover, the luminance of the backlight can be decreased and thereby power consumption can be reduced.

Note that, for easy explanation, the above explanation discusses a case where the liquid crystal display panel is used whose input tones are 64 (0 through 63) tones and a tone-luminance characteristic is γ 2.2. However, the present embodiment is not limited to this. Moreover, the present embodiment is not limited to the configuration in which the compensated gradation values are obtained by the operation. For example, the compensated gradation values can be determined by the use of an LUT (look up table) which is preliminarily prepared and is indicative of relations between inputted gradation values and compensated gradation values for each luminance of the backlight. Moreover, depending on an LSI to be designed, such an exponential operation sometimes cannot be processed properly. In such a case, it is preferable to carry out a gradation conversion with the use of an LUT. Moreover, control can be carried out more easily when a luminance of the backlight is supplied as gamma-converted gradation data, as compared to a case where the luminance of the backlight is supplied as values in 0 through 100%. Therefore, it is mostly more efficient when the compensated gradation values are determined by the use of a combination of an appropriate LUT and a compensation operation, as compared to a case where the calculation is carried out by the exponential operation.

The liquid crystal driving circuit (liquid crystal driving section) 15 controls the liquid crystal display panel 2 in accordance with the pieces of image data which are sent from the compensating circuits 14*a* through 14*d*, so that the liquid crystal display panel 2 displays an image corresponding to the pieces of image data. Note that, in the present embodiment, the liquid crystal driving circuit 15 is described as a single block. However, the liquid crystal driving circuit 15 is not limited to this but can be made up of a plurality of blocks. For example, it is possible to (i) provide liquid crystal driving circuits 15*a* through 15*d* so as to correspond to the respective compensating circuits 14*a* through 14*d*, and (ii) cause the liquid crystal driving circuits 15*a* through 15*d* to drive respective divided areas in the liquid crystal display panel 2. In a case where a single liquid crystal driving circuit 15 drives the whole liquid crystal display panel 2, driving timing of each of the areas can be easily driven at an identical timing. This provides an advantageous effect of easily controlling the areas. However, a circuit size (IC size) becomes large because the number of input-output pins is increased. In a case where a plurality of liquid crystal driving circuits 15 are provided for the respective divided areas, a chip size can be reduced (in particular, the present embodiment is economical because each of the divided areas is of 2K1K class, and accordingly a 2K control chip used in a conventional display device of 2K1K class can be used). However, it is necessary to provide an adjustment circuit for maintaining synchronism among the liquid crystal driving circuits.

Figure 5:
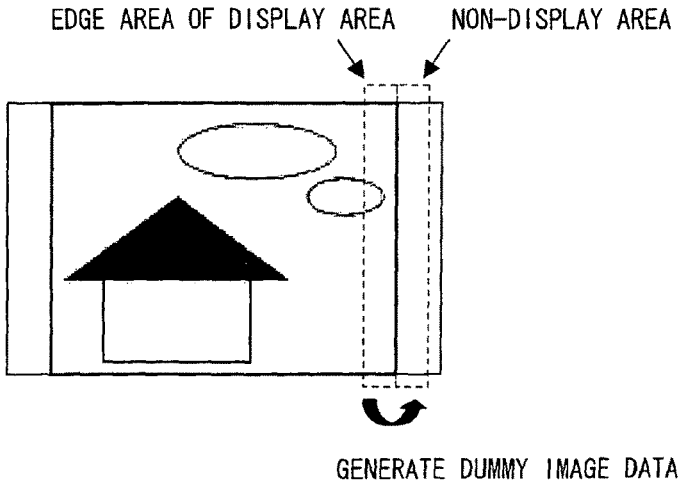
FIG. 5 is an explanatory view illustrating an example of a generating process of mapping image data.

In a case where an aspect ratio of image data supplied via the switch SW1 is different from a ratio of the vertical and horizontal numbers of LEDs arranged in the backlight unit 3, the display map generating circuit (display map generating section) 16 adjusts an image size of the image data so that both the ratios become similar to each other. That is, the display map generating circuit 16 (i) specifies a position where an image corresponding to the image data supplied via the switch SW1 is to be displayed in an area corresponding to each of the LEDs of the backlight unit 3, (ii) mapping, in accordance with the specification result, the image data supplied via the switch SW1 on image data having a resolution which is an integral multiple of a resolution corresponding to an arrangement of LEDs provided in the backlight unit 3, and thereby (iii) generates mapping image data. Note that in a case where an aspect ratio of an image supplied via the switch SW1 is different from a ratio of the vertical and horizontal numbers of arranged LEDs, it is possible to add dummy image data to the image data as appropriate so that both the ratios become identical or similar to each other. In this case, the dummy image data can be made by copying data of pixels which are adjacent to the dummy image data as shown in FIG. 5 or can be made with the use of an average value of a block made up of a plurality of pixels including the adjacent pixels.

The LED resolution signal generating circuit (LED luminance setting section) 17 generates a luminance signal corresponding to an LED resolution (in this embodiment, 8×4) based on mapping image data supplied from the display map generating circuit 16, and supplies the luminance signal to the luminance distribution data generating circuit 18 and the LED driving circuit 19.

Figure 6:
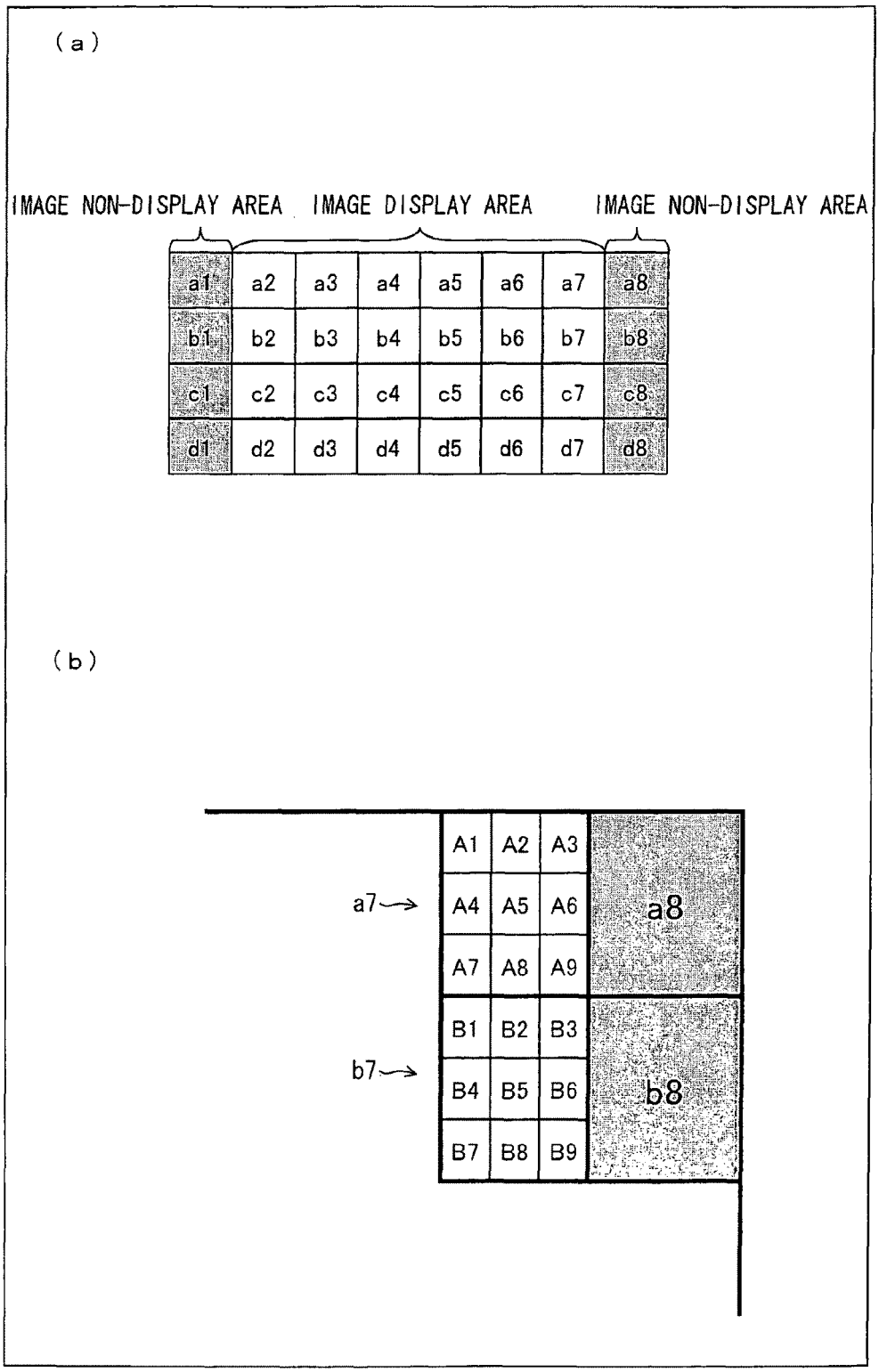
FIG. 6 (a) and (b) of FIG. 6 are explanatory views illustrating examples of methods for generating a luminance signal corresponding to an LED resolution.

Specifically, the LED resolution signal generating circuit 17 divides pixels of mapping image data (2048×1080 dots) supplied from the display map generating circuit 16 into a plurality of blocks (8×4 blocks) corresponding to the LEDs provided in the backlight unit 3 (see (a) of FIG. 6). Accordingly, each of the plurality of blocks is to include data of 256×270 pixels of the mapping image data. With respect to blocks corresponding to an image display area, respective luminance signals are set based on a maximum gradation value of the pixels included in each of the blocks. That is, with respect to the blocks a2 through a7, b2 through b7, c2 through c7, and d2 through d7, which correspond to the image display area, in the blocks shown in (a) of FIG. 6, a maximum luminance value of each of the blocks is assumed as a reference luminance value, and a luminance signal corresponding to each of the blocks is set based on the corresponding reference luminance value.

In a case where, for example, an aspect ratio of inputted image data is different from an aspect ratio of the liquid crystal display panel 2, an area (image non-display area) occurs in which no image data is present in the liquid crystal display panel 2. With respect to each of blocks in the area (image non-display area), the LED resolution signal generating circuit 17 generates a luminance signal based on (i) an average luminance level (APL) of a block in an image display area which block is adjacent to the block in the image non-display area or (ii) on an average luminance level (APL) of a part of a block in an image display area which block is adjacent to the block in the image non-display area.

In the present embodiment, as shown in (b) of FIG. 6, each of the blocks in the image display area adjacent to the image non-display area is further divided into small blocks (accordingly, each of the small blocks is to include data of 85×90 pixels or 86×90 pixels in the mapping image data). Then, an average luminance level (APL) is calculated for each of small blocks (e.g., small blocks A3, A6, and A9 in the block a7) adjacent to a block in the image non-display area. With respect to each of the blocks a1, b1, c1, d1, a8, b8, c8, and d8 which corresponds to the image non-display area, a luminance signal is set based on a reference luminance value which is (i) a maximum value among average luminance levels of small blocks in blocks corresponding to the image display area which small blocks are adjacent to the corresponding blocks a1, b1, c1, d1, a8, b8, c8, or d8, or (ii) an average value of the average luminance levels of the small blocks. Accordingly, in the example of (b) of FIG. 6, a luminance signal corresponding to the block a8 is set based on a maximum value or an average value of average luminance levels of the small blocks A3, A6, and A9; and a luminance signal corresponding to the block b8 is set based on a maximum value or an average value of average luminance levels of the small blocks B3, B6, and B9. Luminance signals corresponding to the respective blocks a1, b1, c1, d1, c8, and d8 are set similarly.

Note that, in a case where a block a9 (not illustrated) in the image non-display area is further provided in an opposite side of the block a7 in the image display area with respect to the block a8 in the image non-display area, a luminance signal corresponding to the block a9 can be set in a similar way to the luminance signal corresponding to the block a8. Alternatively, the luminance signal corresponding to the block a9 can be set based on a value obtained by multiplying a coefficient corresponding to a distance from the image display area by an average value or a maximum value of the average luminance levels of the small blocks A3, A6, and A9. In this case, the coefficient can be set as appropriate in accordance with a luminance distribution characteristic of light emitted from each of the LEDs so that the LEDs disposed on the back of the image non-display area do not adversely affect image quality in the image display area.

Luminance distributions of the plurality of LEDs provided in the backlight unit 3 spread, and accordingly a luminance distribution in the liquid crystal display panel includes the luminance distributions, which overlap each other, of the plurality of LEDs.

Figure 7:
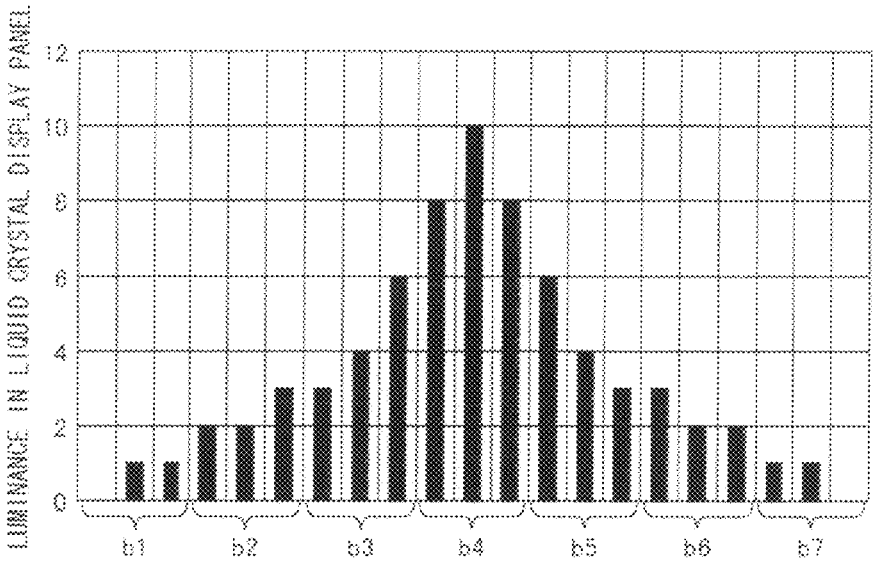
FIG. 7 is a graph illustrating luminances of respective sections in a liquid crystal display panel caused by light emitted from backlights.

FIG. 7 is a graph illustrating a luminance distribution caused by light emitted from the backlight in the blocks b1 through b7 in the liquid crystal display panel in a case where only a LED disposed just beneath the block b4 shown in (a) of FIG. 6 is turned on and the other LEDs are turned off. Note that, in the case of FIG. 7, each of the blocks is divided into small blocks of 3×3, and FIG. 7 illustrates luminances of respective small blocks which are aligned in a horizontal direction.

As shown in FIG. 7, a luminance of a small block disposed in the center of the block b4 is the highest (bright), and the luminance becomes lower (dark) as a distance from the center increases.

Figure 8:
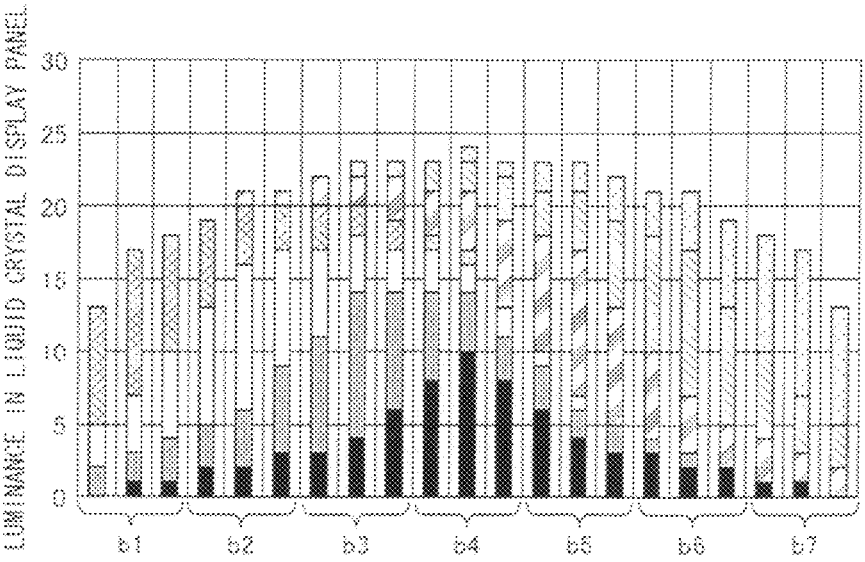
FIG. 8 is a graph illustrating luminances of respective sections in a liquid crystal display panel caused by light emitted from backlights.

FIG. 8 is a graph illustrating a luminance distribution caused by light emitted from the backlight in the blocks b1 through b7 in the liquid crystal display panel in a case where only LEDs disposed just beneath the blocks b1 through b7 shown in (a) of FIG. 6 are turned on and the other LEDs are turned off. Note that, in the case of FIG. 8, each of the blocks is divided into small blocks of 3×3, and FIG. 8 illustrates luminances of respective small blocks which are aligned in a horizontal direction.

As shown in FIG. 8, the blocks b3 through b5 show substantially the same luminances. On the other hand, the blocks b1, b2, b6, and b7 show luminances lower than those shown in the blocks b3 through b5. Moreover, the blocks b3 through b5 show luminances which are far higher than luminances which are shown in the case where only an LED which is disposed just beneath the block b4 is turned on.

As described above, a luminance distribution in a liquid crystal display panel is obtained from luminance distributions, which overlap each other, of a plurality of LEDs.

In the present embodiment, a maximum value of a luminance signal corresponding to each of the blocks is set as a value corresponding to a luminance caused by light emitted from the backlight unit 3 in the corresponding block in the liquid crystal display panel, which luminance is obtained when all LEDs which are disposed just beneath blocks of 3×3 centered on the corresponding block emit light at 100%. However, the present embodiment is not limited to this. For example, in a case where a brighter display is demanded to be carried out by emphasizing a dynamic range, the maximum value of the luminance signal corresponding to each of the blocks can be set higher than the above described case. In a case where the liquid crystal display panel originally has excellent expression property of a dark image or the number of tones is drastically large and compression is not noticeable, the maximum value can be set lower than the above described case.

The luminance caused by light emitted from the backlight in each of the blocks in the liquid crystal display panel is affected by surrounding blocks. Accordingly, it sometimes occurs that sufficient sharpness cannot be obtained by only varying light-emitting luminances of LEDs disposed just beneath blocks adjacent to each other, and thereby a necessary luminance cannot be secured. In view of this, it is preferable to pass the luminance signals through a low-pass filter, etc. so that the luminance signals do not drastically change in the respective blocks. Moreover, in properly obtaining a luminance in one of the blocks by an operation in consideration of effects by LEDs disposed just beneath blocks surrounding the one of the blocks, the operation sometimes becomes complicate, or sometimes the operation cannot be necessarily carried out properly. In view of this, it is possible to use values of the luminance signals for the respective blocks which values are set with the use of a table prepared in advance. The table stores combinations of (i) combinations of the reference luminance values determined for the respective blocks and (ii) values of luminance signals set for the respective blocks which values correspond to the respective combinations of the reference luminance values. Moreover, it is further possible to carry out a smoothing process, by a low-pass filter, on the values of the luminance signals set for the respective blocks with the use of the table.

In the present embodiment, a white backlight is used and a luminance of the white backlight is controlled with the use of luminance information obtained from image data. However, the present embodiment is not limited to this. For example, it is possible to provide backlights of respective RGB colors and control luminances of the respective RGB colors separately. In that case, contrast can be improved and contrast between colors in one area can also be increased. This makes it possible to produce vivid video with high color purity. Moreover, when a luminescence spectrum of the backlight and an absorption spectrum of a color filter are matched, independence between colors can be increased.

In the descriptions above, each of the blocks is divided into 9 small blocks arranged in a matrix of 3×3. However, the present embodiment is not limited to this. As the division number is increased, discontinuity of luminance caused by the backlight becomes less likely to occur. On the other hand, when the division number is increased too much, a problem of increase of a circuit size occurs. Therefore, the division number can be set as appropriate in consideration of these characteristics.

Note that, the division number is greatly affected by a fineness of video to be displayed, an SN ratio, and the like. Accordingly, it is preferable to set the division number as appropriate in accordance with a type of inputted video, an SN ratio, and the like. For example, in a case where HD video (video of approximately 1440×1080 dots) was magnified and displayed on a liquid crystal display panel of a 4K×2K class, no visible defect occurred when each of blocks, which has 128×128 pixels, was divided into 8×8=64 small blocks. Moreover, in a case where DVD video (video of approximately 720×480 dots) was magnified and reproduced, no particular defect occurred when the video was divided into approximately 4×4. Note that, in a case of pure 4K video (which is originally generated as video data of 4K2K class), it is preferable to divide the pure 4K video into 16×16 or more in order to display an image with higher quality.

In the present embodiment, for convenience of explanation, the LED resolution (the number of arranged LEDs) is 8×4. However, the LED resolution is not limited to this. In order to improve video quality, it is preferable to increase the LED resolution. Specifically, it is preferable to set the LED resolution to approximately 16×8 to 64×32 so that a block corresponding to a single LED corresponds to pixels of approximately 64×64 dots to 256×256 dots in image data of 4K2K class. When the LED resolution is set to 16×8 or more, it is possible to prevent a user from visually recognizing a difference of luminances between the blocks and allow the user to watch sharp vide. Moreover, it is preferable that the LED resolution is set to 64×32 or less because, in a case where the LED resolution is too high, problems such as increase of a circuit size and enlargement of a power supply circuit for LED occur. A shape of a block corresponding to each of the LEDs is not limited to a square but can be set as appropriate in accordance with the number and arrangements of members.

The luminance distribution data generating circuit (luminance distribution data generating section) 18 generates luminance data (luminance distribution data) of pixels which luminance data is obtained from luminance distributions, which (i) are caused by lights emitted from the respective LEDs in a case where the LEDs are driven in accordance with the respective luminance signals corresponding to the LED resolution generated by the LED resolution signal generating circuit 17 and (ii) overlap each other, in the liquid crystal display panel 2. Then, the luminance distribution data generating circuit 18 divides the generated luminance distribution data into pieces of luminance distribution data for respective display areas in the liquid crystal display panel 2, and sends the pieces of luminance distribution data to the respective compensating circuits 14*a* through 14*d*.

Figure 9:
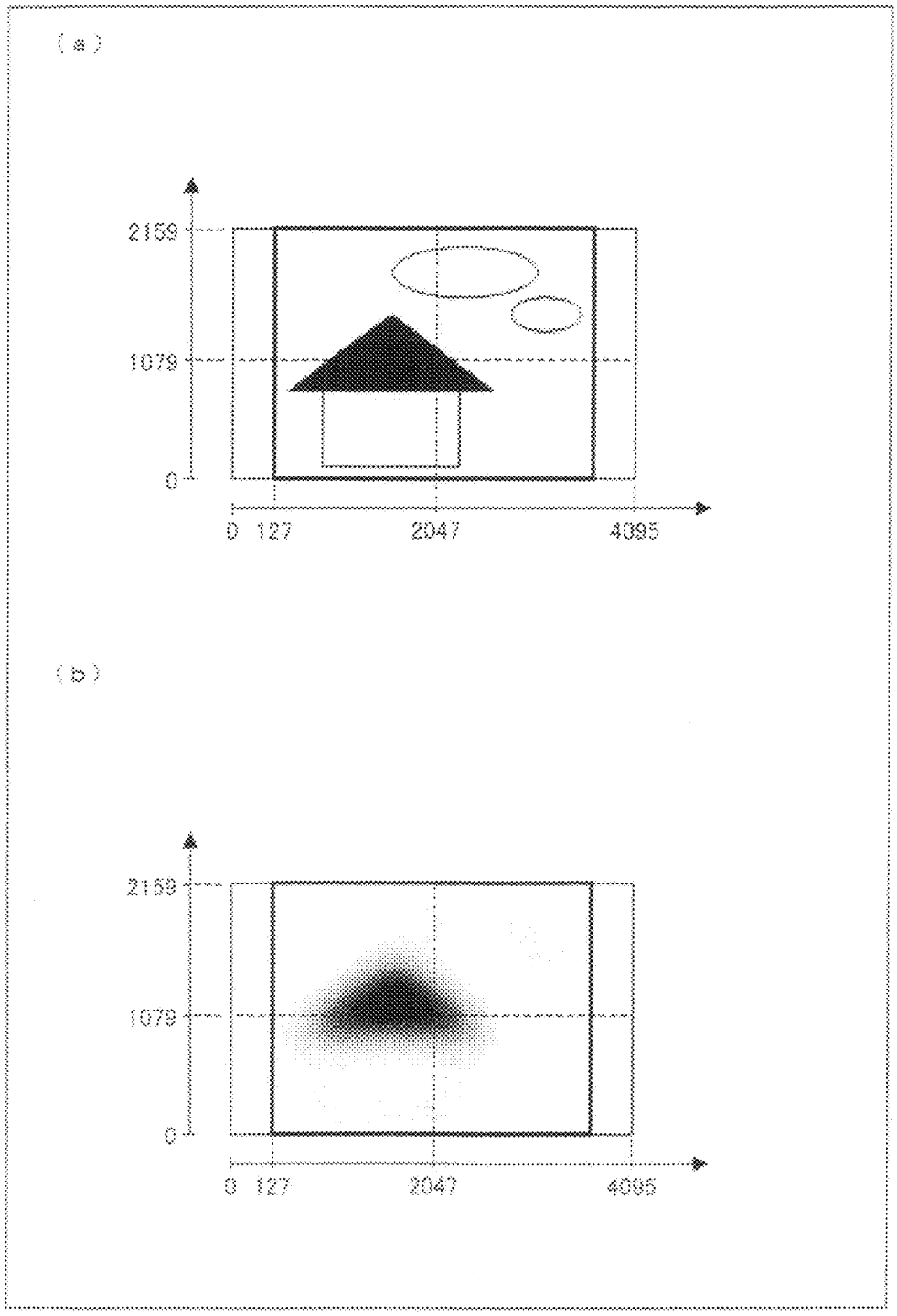
FIG. 9 (a) of FIG. 9 is an explanatory view illustrating an example of an image to be displayed on a liquid crystal display panel and (b) of FIG. 9 is an explanatory view illustrating a luminance distribution of the liquid crystal display panel caused by light emitted from a backlight unit whose light-emitting state is controlled in accordance with the image of (a).

Each of the LEDs is a point light source. Light emitted from each of the LEDs is diffused while traveling to the liquid crystal display panel 2, and accordingly each of luminance distributions in the liquid crystal display panel 2 shows a mountain shape whose peak corresponds to a position just above the corresponding LED. That is, in the liquid crystal display panel 2, a luminance at a position just above the corresponding LED is high and the luminance becomes lower as a distance from the position increases. With the configuration, the luminance distribution data generating circuit 18 generates luminance distribution data by calculating a luminance distribution in the liquid crystal display panel 2 caused by the whole backlight unit 3 (all the LEDs provided in the backlight unit 3) with the use of the luminance distributions which is caused in the liquid crystal display panel 2 by the respective LEDs and overlap each other. (a) of FIG. 9 illustrates an example of image data to be displayed on the liquid crystal display panel 2. (b) of FIG. 9 illustrates an example of luminance distribution data corresponding to the image data.

The LED driving circuit (LED driving section) 19 controls luminances of the respective LEDs based on the luminance signals corresponding to the LED resolution generated by the LED resolution signal generating circuit 17. That is, the LED driving circuit 19 controls light-emitting luminances of the respective LEDs so that each of the light-emitting luminances corresponds to a luminance in dots, which correspond to each of the LEDs, in the luminance signal.

(1-2. Process in Control Device 1)

Figure 10:
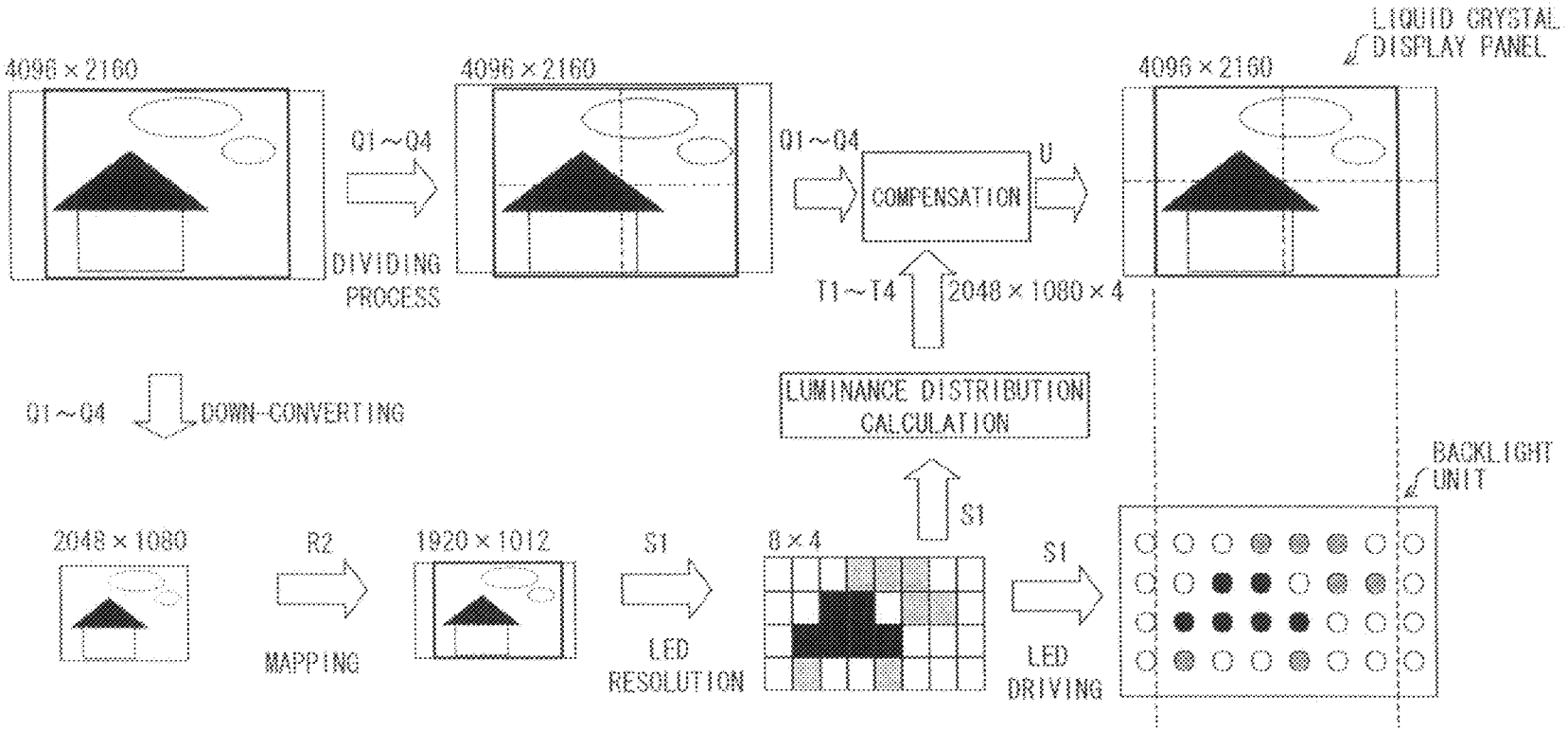
FIG. 10 is an explanatory view schematically illustrating a process flow of the liquid crystal display device shown in FIG. 1.

The following describes a process flow in the control device 1. First, the following describes a case where four pieces of image data P1, P2, P3, and P4 are supplied to the control device 1. The four pieces of image data P1, P2, P3, and P4 (i) are prepared by dividing image data of 3840×2160 dots into four pieces so that each of the four pieces of image data P1, P2, P3, and P4 has an image size of 1920×1080 dots, and (ii) correspond to respective four areas of upper left, lower left, upper right, and lower right. FIG. 10 is an explanatory view schematically illustrating a process in the control device 1 in this case.

The preprocessing circuit 10 (i) generates pieces of image data Q1, Q2, Q3, and Q4 by expanding the respective pieces of image data P1, P2, P3, and P4 to 2040×1080 dots, and (ii) sends the pieces of image data Q1, Q2, Q3, and Q4 to the down-converter 13 and the dividing circuit 11*a*. The dividing circuit 11*a* sends the pieces of image data Q1, Q2, Q3, and Q4 to the compensating circuits 14*a* through 14*d* via the switches SW2*a* through SW2*d*, respectively. At this point, the preprocessing circuit 10 carries out the expansion by (i) right-aligning the pieces of image data in upper left and lower left, (ii) adding dummy image data (e.g., black pixels) to the left sides of the pieces of image data in upper left and lower left, (iii) left-aligning the pieces of image data in upper right and lower right, and (iv) adding dummy image data (e.g., black pixels) to the right sides of the pieces of image data in upper right and lower right. Note that, in a case where a longitudinal size of inputted image data is different from that of the liquid crystal display panel, the expansion can be carried out by (i) bottom-aligning the pieces of image data in upper left and upper right, (ii) adding dummy image data to the upper sides of the pieces of image data in upper left and upper right, (iii) top-aligning the pieces of image data in lower left and lower right, and (iv) adding dummy image data to the lower sides of the pieces of image data in lower left and lower right.

The down-converter 13 generates image data R1 of 1920×1080 dots by down-converting image data of 4096×2160 dots obtained by combining the pieces of image data Q1, Q2, Q3, and Q4, and sends the image data R1 to the display map generating circuit 16 via the switch SW1.

The display map generating circuit 16 carries out a mapping process for conforming an aspect ratio of the inputted image data to an aspect ratio of the backlight unit 3, and thereby generates mapping image data R2. In this case, for areas in which no image data is present, image data of the peripheral pixels can be copied, or an average value of image data of a plurality of pixels including the peripheral pixels can be used.

Then, the LED resolution signal generating circuit 17 generates a luminance signal S1 corresponding to an LED resolution based on the mapping image data generated by the display map generating circuit 16, and sends the luminance signal S1 thus generated to the luminance distribution data generating circuit 18 and the LED driving circuit 19. The luminance signal S1 are generated with the method described above.

The luminance distribution data generating circuit 18 (i) calculates a luminance distribution (luminance of the pixels) T in the liquid crystal display panel 2 caused by light emitted from the LEDs which are driven based on the luminance signal S1 corresponding to the LED resolution sent from the LED resolution signal generating circuit 17, (ii) divides the calculated luminance distribution T for each of display areas in the liquid crystal display panel 2 and thereby generates luminance distribution signals T1 through T4 for the respective areas, and (iii) sends the luminance distribution signals T1 through T4 to the respective compensating circuits 14*a* through 14*d*.

The compensating circuits 14*a* through 14*d* respectively compensate gradation levels of the pieces of image data Q1 through Q4 according to the luminance distribution signals T1 through T4 sent from the luminance distribution data generating circuit 18, and send pieces of image data U1 through U4, which have been prepared by the compensation, to the liquid crystal driving circuit 15.

The liquid crystal driving circuit 15 causes the display areas of the liquid crystal display panel 2 to display images respectively according to the pieces of image data U1 through U4 sent from the compensating circuits 14*a* through 14*d*. Moreover, in sync with this, the LED driving circuit 19 controls light-emitting states of the respective LEDs in response to the luminance signals sent from the LED resolution signal generating circuit 17.

The following describes a case where image data P1 of 1920×1080 dots is supplied to the control device 1.

In this case, the preprocessing circuit 10 adds dummy image data (e.g., black pixels) to the image data P1 of 1920×

1080 dots so as to expand the image data P1 to image data PX1 of 2048×1080 dots which is the same aspect ratio as that of the liquid crystal display panel 2. At this point, the preprocessing circuit 10 adds dummy image data to peripheral parts of the image data P1 so that an image corresponding to the image data P1 is ultimately displayed in substantially the center of the display area of the liquid crystal display panel 2. The image data PX1 generated by the preprocessing circuit 10 is sent to the dividing circuit 11*b* and the display map generating circuit 16.

The display map generating circuit 16 carries out a mapping process for conforming an aspect ratio of the inputted image data to an aspect ratio of the backlight unit 3, and thereby generates mapping image data R2. In this case, for areas in which no image data is present, image data of the peripheral pixels can be copied, or an average value of image data of a plurality of pixels including the peripheral pixels can be used.

Then, the LED resolution signal generating circuit 17 generates a luminance signal S1 corresponding to an LED resolution based on the mapping image data generated by the display map generating circuit 16, and send the luminance signal S1 thus generated to the luminance distribution data generating circuit 18 and the LED driving circuit 19. The luminance signal S1 are generated by the method described above.

The luminance distribution data generating circuit 18 (i) calculates a luminance distribution (luminance of the pixels) T in the liquid crystal display panel 2 by the LEDs which are driven based on the luminance signal S1 corresponding to the LED resolution sent from the LED resolution signal generating circuit 17, (ii) divides the calculated luminance distribution T for each of display areas in the liquid crystal display panel 2, and (iii) sends respective luminance distribution signals T1 through T4 for the areas to the compensating circuits 14*a* through 14*d*.

On the other hand, the dividing circuit 11*b* divides the image data P1 supplied from the preprocessing circuit 10 into pieces of image data QX1 through QX4 respectively corresponding to four areas of upper left, lower left, upper right, and lower right, and sends the pieces of image data QX1 through QX4 to the respective upscaling circuits 12*a* through 12*d*. The upscaling circuits 12*a* through 12*d* respectively up-convert the pieces of image data QX1 through QX4 to pieces of image data each of which has an image size of 2048×1080 dots, and send the pieces of image data, which have been up-converted, to the compensating circuits 14*a* through 14*d*. Note that details of the dividing process in the dividing circuit 11*b* and the upscaling process in the upscaling circuits 12*a* through 12*d* are described later.

The compensating circuits 14*a* through 14*d* respectively compensate gradation levels of the pieces of image data Q1 through Q4 in accordance with the luminance distribution signals T1 through T4 supplied from the luminance distribution data generating circuit 18, and send pieces of image data U1 through U4, which have been compensated, to the liquid crystal driving circuit 15.

The liquid crystal driving circuit 15 causes the display areas in the display liquid crystal display panel 2 to display respective images corresponding to the pieces of image data U1 through U4 supplied from the compensating circuits 14*a* through 14*d*. Moreover, in sync with this, the LED driving circuit 19 controls light-emitting states of the respective LEDs in response to the luminance signals sent from the LED resolution signal generating circuit 17.

Note that, in the present embodiment, the compensating circuit is divided into four compensating circuits 14*a* through 14*d*. However, the present embodiment is not limited to this. For example, the compensating circuit can be made up of a single circuit in a case where memory capacity and a processing speed can be secured sufficiently. In this case, it is possible that the luminance distribution data generating circuit 18 sends a luminance distribution T which corresponds to the whole area of the liquid crystal display panel 2 to the compensating circuit, and the compensating circuit compensates gradation values of the pieces of image data Q1 through Q4 based on the luminance distribution T and sends pieces of image data U1 through U4, which have been compensated, to the liquid crystal driving circuit 15.

The backlight unit 3 can be a backlight unit which has colors of R, G, and B whose luminances can be controlled separately. Alternatively, the backlight unit 3 can be a white LED or a CCFL with which luminance control for different colors cannot be carried out. In a case where the luminance control for different colors cannot be carried out, it is possible that, in order to reduce a circuit size, the display map generating circuit 16 converts inputted image data for an RGB color space into image data for a YUV color space, and the luminance distribution data generating circuit 18 converts the data for the YUV color space into data for an RGB color space and sends the data for the RGB color space to the compensating circuits 14*a* through 14*d*.

(1-3. Processes in Dividing Circuit 11*b* and Upscaling Circuits 12*a* Through 12*d*)

The following describes a method for dividing image data in the dividing circuit 11*b* and an upscaling process in each of the upscaling circuits 12*a* through 12*d*.

Figure 11:
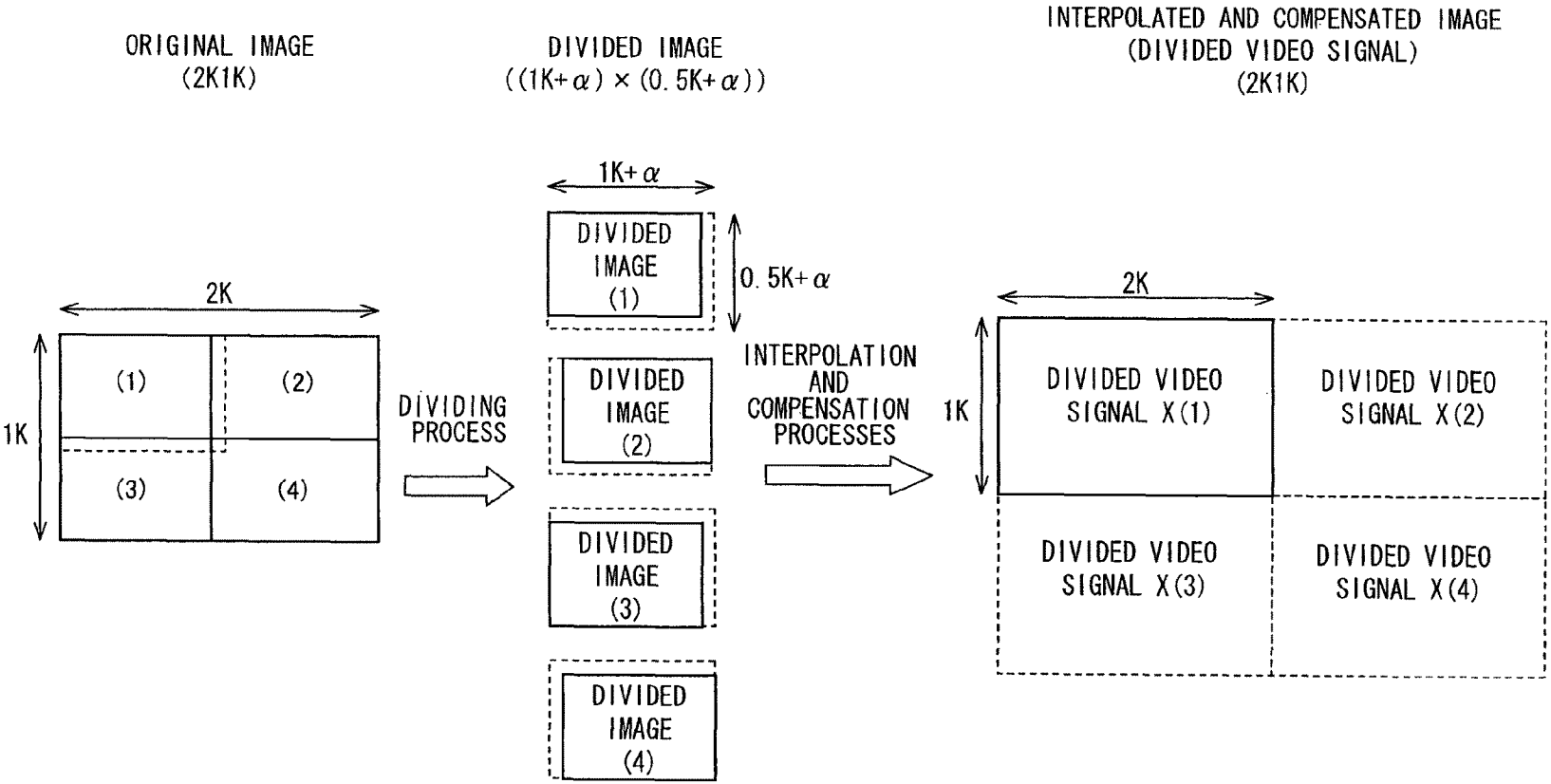
FIG. 11 is an explanatory view illustrating an overview of an upscaling process carried out by the liquid crystal display device shown in FIG. 1.

FIG. 11 is an explanatory view schematically illustrating processes carried out in the dividing circuit 11*b* and the upscaling circuits 12*a* through 12*d*. As shown in FIG. 11, when 2K1K image data is supplied, as inputted image (original image) data, to the dividing circuit 11*b*, the dividing circuit 11*b* divides the inputted image data into four pieces of divided image data of $(1K+\alpha)\times(0.5K+\alpha)$. Note that each of dashed parts (corresponding to parts $\alpha$) shown in FIG. 11 represents a part which overlaps the adjacent one of the divided image data.

The upscaling circuits 12*a* through 12*d* carry out interpolation processes (upscaling processes) on the respective pieces of the divided image data divided as described above, and accordingly 2K1K interpolated image data (upscaled image data) is produced. Note that each of the upscaling circuits 12*a* through 12*d* carries out the interpolation processes concurrently with the other of the upscaling circuits 12*a* through 12*d*.

Then, the compensating circuits 14*a* through 14*d* carry out the above described compensating processes on the respective pieces of the interpolated image data which are interpolated by the upscaling circuits 12*a* through 12*d*, and the liquid crystal driving circuit 15 (i) generates divided video signals corresponding to the respective pieces of the interpolated and compensated image data and (ii) causes the liquid crystal display panel 2 to display, in the divided areas, images corresponding to the divided video signals.

Figure 12:
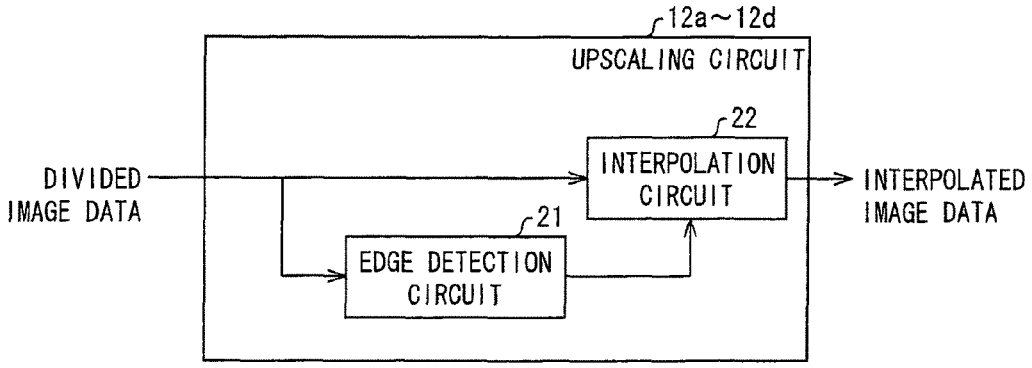
FIG. 12 is a block diagram schematically illustrating a structure of an upscaling circuit included in the liquid crystal display device shown in FIG. 1.

FIG. 12 is a block diagram schematically illustrating a structure of each of the upscaling circuits 12*a* through 12*d*. As shown in FIG. 12, each of the upscaling circuits 12*a* through 12*d* includes an edge detection circuit 21 and an interpolation circuit 22. The edge detection circuit 21 detects a position and a direction of an edge contained in divided image data. The interpolation circuit 22 carries out interpolation processes with the use of respective different interpolation methods on an edge part and a non-edge part. Specifically, the interpolation circuit 22 interpolates the edge part with the use of an average value of values of pixels which are adjacent to each other in the edge direction. On the other hand, the interpolation circuit 22 interpolates the non-edge part with the use of a weighted average value of values of pixels adjacent to each other at all azimuths.

Figure 13:
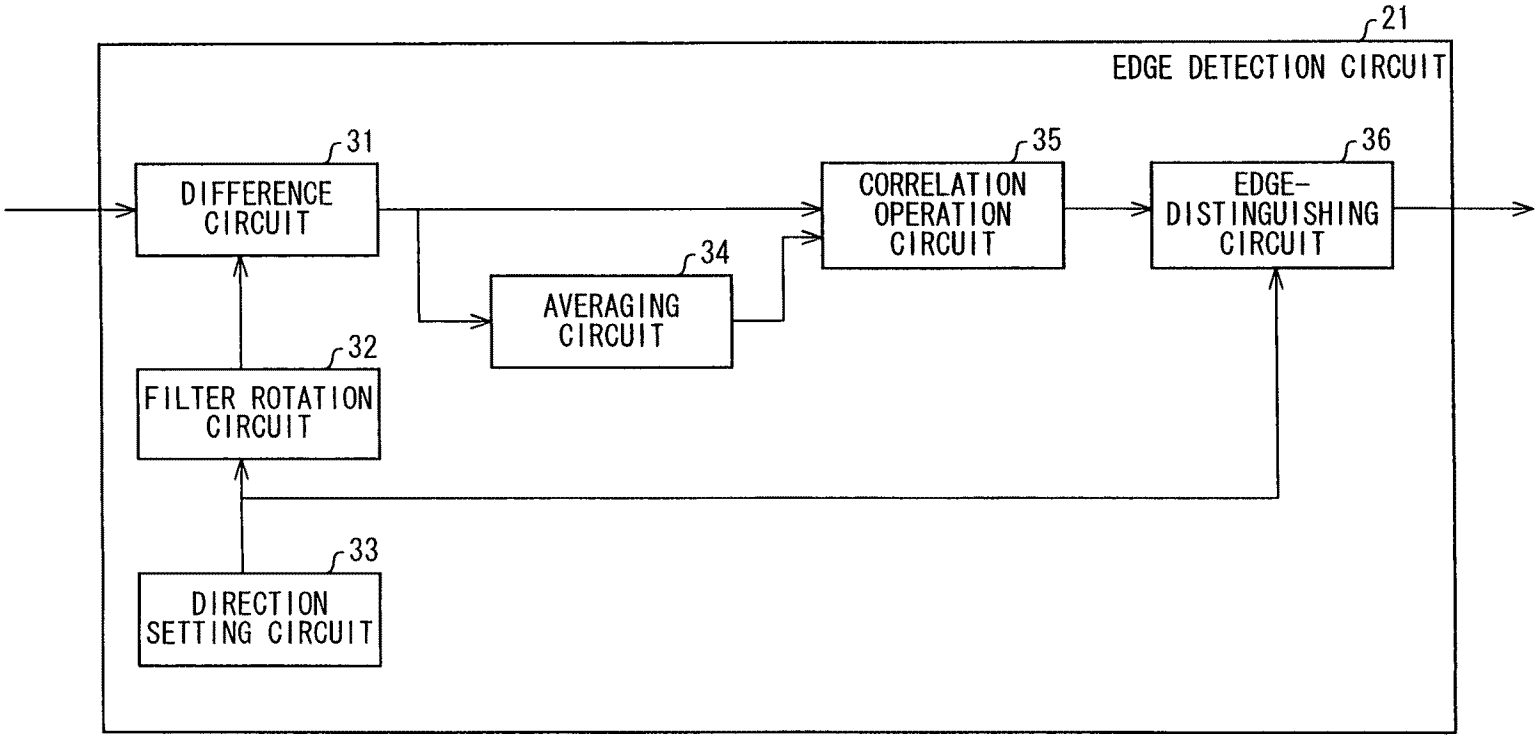
FIG. 13 is a block diagram schematically illustrating a structure of an edge detection circuit included in the liquid crystal display device shown in FIG. 1.

FIG. 13 is a block diagram schematically illustrating a configuration of the edge detection circuit 21. As shown in FIG. 13, the edge detection circuit 21 includes a difference circuit 31, a filter rotation circuit 32, a direction setting circuit 33, an averaging circuit 34, a correlation operation circuit 35, and an edge-distinguishing circuit 36.

The difference circuit 31 (i) calculates difference image data by carrying out a difference operation, with the use of a difference filter, on received image data and (ii) sends the calculated difference image data to the averaging circuit 34 and the correlation operation circuit 35.

For example, as shown in FIG. 14, a difference filter made up of 3×3 dots to each of which a filter coefficient is assigned is applied to a block made up of 5×5 dots centered on a target pixel in inputted image data, whereby a difference operation result of 3×3 dots centered on the target pixel is obtained. In this case, the difference operation is represented as:

$$bkl = \sum_{i=1}^{3}\sum_{j=1}^{3} d(i+k-1)(j+l-1)\cdot aij \quad \text{[Formula 1]}$$

where dij is a pixel value of each dot in the inputted image data (i and j are independently an integer between 1 through 3), aij is the difference filter, bkl is a pixel value of each dot in the difference operation result (k and l are independently an integer between 1 through 3).

Note that, according to the present embodiment, the difference filter aij is a filter of 1:2:1 as represented by a formula below:

$$aij = \begin{pmatrix} -1 & 0 & 1 \\ -2 & 0 & 2 \\ -1 & 0 & 1 \end{pmatrix} \quad \text{[Formula 2]}$$

Note that the difference filter aij is not limited to this but can be a difference filter which is capable of extracting an edge of an article pictured in an image by an operation with the use of differentiation or difference of gradation values in vicinity to a target pixel. For example, such a difference filter can be a filter of 3:2:3, 1:1:1, or 1:6:1, as represented below:

$$aij = \begin{pmatrix} -3 & 0 & 3 \\ -2 & 0 & 2 \\ -3 & 0 & 3 \end{pmatrix} \quad \text{[Formula 3]}$$

$$aij = \begin{pmatrix} -1 & 0 & 1 \\ -1 & 0 & 1 \\ -1 & 0 & 1 \end{pmatrix}$$

$$aij = \begin{pmatrix} -1 & 0 & 1 \\ -6 & 0 & 6 \\ -1 & 0 & 1 \end{pmatrix}$$

In a case where a difference filter is represented as a:b:a, the larger a weight of b becomes, the more accurately a vicinity of a target pixel can be evaluated but the more easily the difference filter gets affected by noise. The smaller a weight of b becomes, the more comprehensively a vicinity of the target pixel can be judged but the more easily small change is missed. Therefore, a filter coefficient of the difference filter can be selected appropriately in accordance with a target image characteristic. For example, in a case of contents such as a photograph which is substantially precise and hardly includes a blur, a characteristic of the contents can be seen more easily as the weight of b becomes larger. In a case of contents such as a video of quick movements, in particular, a dark video which easily includes a blur or noise, it is possible to prevent misjudge by relatively reducing the weight of b. According to the present embodiment, the difference filter is made up of 3×3 dots. However, the present invention is not limited to this. For example, a difference filter of 5×5 dots or 7×7 dots can be used.

The filter rotation circuit 32 carries out a rotation process on the difference filter used in the difference circuit 31. The direction setting circuit 33 controls rotation of the difference filter by the filter rotation circuit 32 and sends, to the edge-distinguishing circuit 36, a signal indicative of an application state of the difference filter.

According to the present embodiment, inputted image data is subjected to a difference operation with the use of the difference filter aij so that edge detection process is carried out in a horizontal direction. Then, the inputted image data is subjected to a difference operation again, with the use of a filter which is obtained by rotating the difference filter aij by 90 degrees, so that an edge in a vertical direction is detected. Note that edge detection processes can be concurrently carried out in the horizontal and vertical directions. This can be carried out by providing two sets of the difference circuit 31, the filter rotation circuit 32, the direction setting circuit 33, the averaging circuit 34, the correlation operation circuit 35, and the edge-distinguishing circuit 36.

FIG. 15 is a chart illustrating an image (image A) of a clear edge in the vertical direction, an image (image B) of a thin line extending in the vertical direction, an image (image C) of irregular lines, and results of difference operations in the horizontal direction and the vertical direction carried out, with the use of a difference filter of 1:2:1, on the images.

As shown in FIG. 15, each of the images A through C has an identical pattern of 3×3 dots centered on a target pixel (center pixel) in inputted image data. Regarding the images A through C, each result (center value) obtained by carrying out horizontal difference operations on the respective target pixels is 4. However, each ratio between (i) an average value in the block of 3×3 dots centered on the target pixel and (ii) the center value obtained by the horizontal difference operation is: 0.67 in the picture A; 0.33 in the picture B; and 0.22 in the picture C. This indicates that the value becomes larger as the image includes a clearer edge (or a clearer image similar to an edge). That is, the image B of thin line may be either an edge or a pattern (texture), and accordingly the average value (indicative of likeness to an edge) of the image B becomes approximately half of that of the image A. Moreover, it is impossible to judge whether the image C of irregular lines is a real edge or noise, and accordingly the average value of the image C becomes approximately ⅓ of that of the image A.

Note that, in a case where the difference image data is a block of 5×5 dots or a block of 7×7 dots, differences among average values of the images A through C in the inputted image data are smaller than those of the block of 3×3 dots. Accordingly, it is necessary to carry out detailed conditional judgment in a case where edge detection is carried out with the use of the average values of the difference image data of the block of 5×5 dots or the block of 7×7 dots. Therefore, it is preferable to use the difference image data of 3×3 dots in the edge detection process. Note that the difference image data of 3×3 dots can be obtained by referring to the block of 5×5 dots in the inputted image data.

In a case where a circuit size can be enlarged, in addition to the edge detection with the use of the difference image data of 3×3 dots, edge detection process can be carried out with the used of the difference image data of 5×5 dots and/or 7×7 dots. Results of the process can be stored in a database which can be exceptionally used in a case of a detection failure in the edge detection with the use of the difference image data of 3×3 dots. This makes it possible to carry out more accurate edge detection. For example, even an edge which is mixed in a highly-repetitive texture pattern can be appropriately detected.

FIG. 16 is a chart illustrating an image (image D) of a clear edge in an oblique direction, an image (image E) of a thin line extending in an oblique direction, an image (image F) of irregular lines, and results of difference operations in the horizontal direction and the vertical direction carried out, with the use of a difference filter of 1:2:1, on the images D through F.

According to the results of horizontal and vertical difference operations carried out on the images D and E, each ratio between (i) an average value in the block of 3×3 dots centered on the target pixel and (ii) the center value is 0.67 in the picture D and 0.33 in the picture E. This indicates, as with the results of horizontal difference operation on the images A and B, that the value of the ratio becomes larger as the image expresses clearer edge (or clearer image similar to an edge). According to the image F, the ration between (i) an average value in the block of 3×3 dots and (ii) the center value is 0.06. With the ratio, it is difficult to judge the image F as an edge.

FIG. 17 is a chart illustrating an image (image G) of an edge with inclination of ½, an image (image H) of an edge with inclination of 1, an image (image I) of an edge with inclination of 2, and results of difference operations in the horizontal direction and the vertical direction carried out, with the use of a difference filter of 1:2:1, on the images G through I. Each of the images G through I shown in FIG. 17 represents an edge part. According to the results of horizontal and vertical difference operations carried out on the images G through I, each ratio between (i) an average value in the block of 3×3 dots centered on the target pixel and (ii) the center value is rather high.

Moreover, respective ratios between (i) the respective center values obtained by the horizontal difference operations carried out on the images G through I and (ii) the respective center values obtained by the vertical difference operations carried out on the images G through I are 2/4 in the image G, 3/3 in the image H, and 4/2 in the image I. These ratios accord with the respective inclinations of the edge in images G through I. According to the present embodiment, in a case where the edge-distinguishing circuit 36 (which is described later) judges that the target pixel is an edge part, the edge-distinguishing circuit 36 calculates, in accordance with the feature described above, an inclination of the edge based on the ratio between the center values (target pixel values) obtained by the horizontal and vertical difference operations. Note that, according to a horizontal or vertical edge, the center value obtained by the horizontal operation or the vertical operation becomes 0. This makes it possible to easily judge an edge direction.

The averaging circuit 34 produces, based on the difference image data bij supplied from the difference circuit 31, averaged image data in which a value obtained by averaging pixel values of a target pixel and the peripheral pixels is defined as a pixel value of the target pixel.

Figure 18:
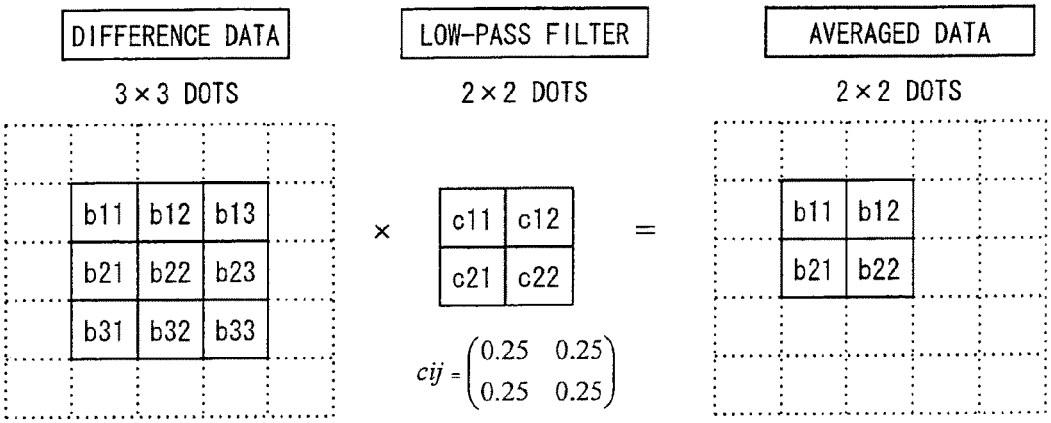
FIG. 18 is an explanatory view illustrating an overview of an averaging process carried out in the liquid crystal display device shown in FIG. 1.

Note that the averaging process can be carried out by a filter process with the use of a low-pass filter (LPF) of 2×2 dots as shown in FIG. 18 for example. According to the example shown in FIG. 18, a low-pass filter made up of 2×2 dots to each of which a filter coefficient is assigned is applied to a block made up of 3×3 dots in the difference image data sent from the difference circuit 31, whereby an averaging process result of 2×2 dots is obtained. In this case, the averaging operation is represented as:

[Formula 4]

$$b11 = \sum_{i=1}^{2}\sum_{j=1}^{2} dij \cdot aij$$

$$b12 = \sum_{i=1}^{2}\sum_{j=1}^{2} di(j+1) \cdot aij$$

$$b21 = \sum_{i=1}^{2}\sum_{j=1}^{2} d(i+1)j \cdot aij$$

$$b22 = \sum_{i=1}^{2}\sum_{j=1}^{2} d(i+1)(j+1) \cdot aij$$

where bij is a pixel value of each dot in the difference image data (i and j are independently an integer between 1 to 3), cij is the low-pass filter, and b'ij is a pixel value of each dot in the averaged image data.

Moreover, the averaging circuit 34 calculates b13, b23, b31, b32, and b33 by carrying out similar operations on each of the dots, one by one, in the block of the 3×3 dots in the difference image data. That is, the averaging circuit 34 calculates averaged image data for a total of 9 pixels including a target pixel and the surrounding 8 pixels. Then, the averaging circuit 34 sends the averaged image data of the 9 pixels to the correlation operation circuit 35.

The correlation operation circuit 35 calculates a value indicative of a correlation between the difference image data sent from the difference circuit 31 and the averaged image data sent from the averaging circuit 34. Specifically, the correlation operation circuit 35 calculates (i) an average value A of the difference image data, sent from the difference circuit 31, of 9 pixels centered on a target pixel and (ii) an average value B of the averaged image data, sent from the averaging circuit 34, of the 9 pixels centered on the target pixel. Then, the correlation operation circuit 35 carries out, based on the average values A and B, calculation processes on the target pixel for obtaining correlation values R=B/A in the horizontal and vertical directions. Subsequently, a larger one of the correlation value R calculated in the horizontal and the correlation value R calculated in the vertical directions is selected and sent to the edge-distinguishing circuit 36.

The edge-distinguishing circuit 36 compares the correlation value R of the target pixel sent from the correlation operation circuit 35 with a predetermined threshold value Th so as to judge whether or not the target pixel is an edge pixel. Note that the threshold value Th may be predetermined by carrying out an experiment in which (i) correlation values R of pixels are calculated based on a large number of sample images and (ii) a correlation value R calculated for a pixel in an edge part is compared to a correlation value R calculated for a pixel in a non-edge part.

Figure 19:
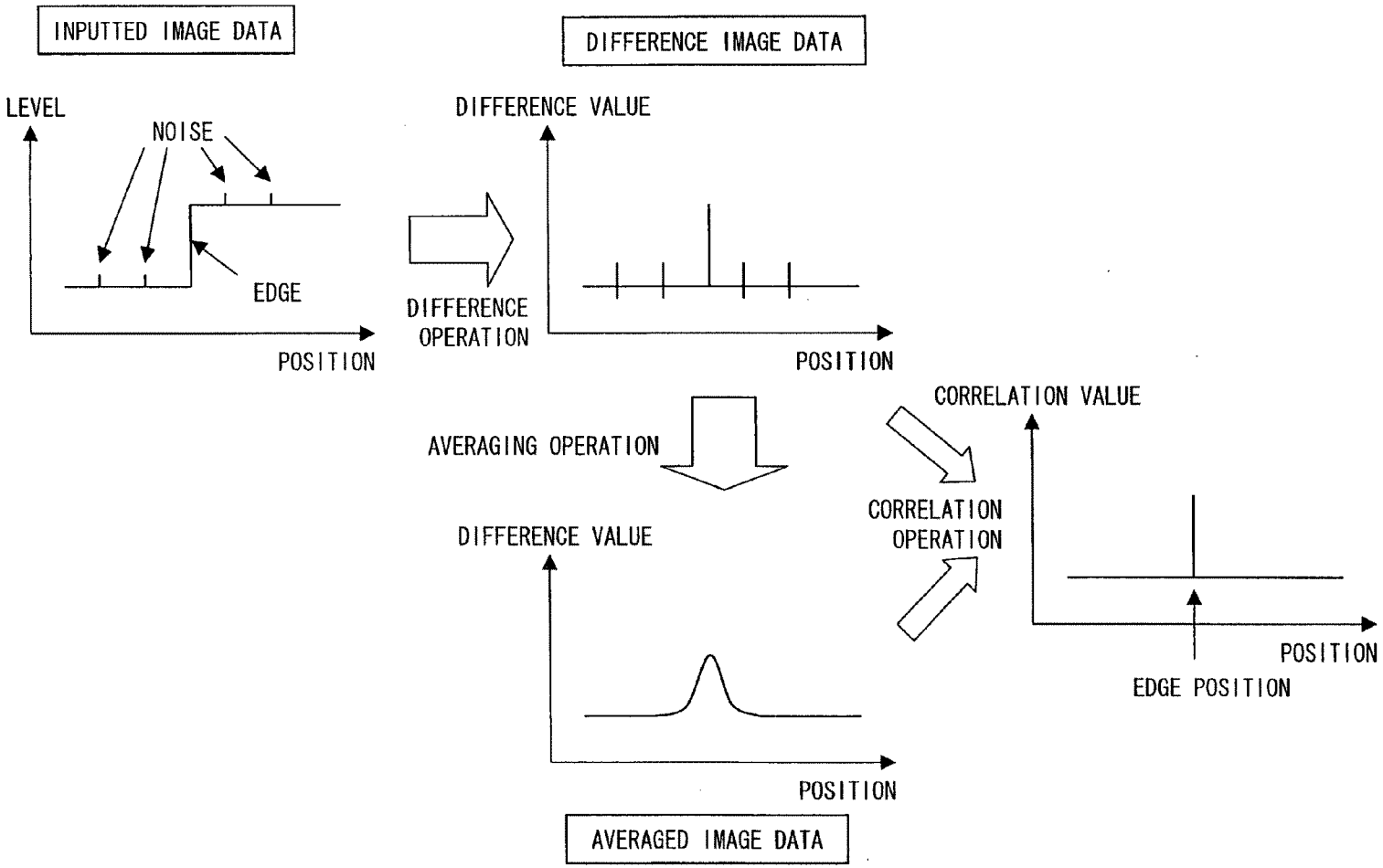
FIG. 19 is an explanatory view illustrating an overview of an edge detection process carried out in the liquid crystal display device shown in FIG. 1.

FIG. 19 is an explanatory view illustrating an overview of an edge detection process carried out by the edge-distinguishing circuit 36. As shown in FIG. 19, in a case where inputted image data includes both an edge part and noise, difference image data is affected by the edge part and the noise. Accordingly, if edge detection is carried out with the use of only the difference image data, the noise will affect the edge detection.

That is, in a case where inputted image data contains an edge which extends in the longitudinal direction, difference image data which is obtained by carrying out the difference operation on the inputted image data has a value other than 0. In a case where no gradation variation exists in the inputted image data, the value becomes 0. Note however that, in a case where noise or fine vertical stripes exist, the difference image data has a value other than 0.

In view of this, the noise can be eliminated out of the difference image data by carrying out the averaging process on the difference image data (see FIG. 19).

That is, noise existing in a single dot within a range to be averaged will be eliminated by the averaging process. Moreover, it is possible to eliminate minute noise, texture, and the like by enlarging the range to be averaged, like 3×3 dots, 4×4 dots, and 5×5 dots.

On the other hand, the edge part divides relatively large areas. Accordingly, difference information before the averaging process is easily maintained in an averaged block.

According to the configuration, a correlation between the difference image data and the averaged image data which is obtained by averaging the difference image data is checked. This makes it possible to accurately detect an edge part while distinguishing noise or a texture from the edge.

That is, in the averaged image data, noise or a texture are eliminated while the edge part remains after the averaging process. Accordingly, the correlation value R becomes large in the edge part whereas the correlation value R becomes small in the non-edge part. Moreover, the correlation value R is 1 or a value close to 1 in the edge part whereas the correlation value R in the non-edge part is far smaller than the correlation value in the edge part. Therefore, it is possible to highly accurately detect an edge part by (i) checking, by an experiment, etc. in advance, a range in which the correlation value drastically changes and (ii) predetermining a threshold value Th within the range.

The edge-distinguishing circuit 36 (i) detects an edge direction (a direction in which the edge extends) with the use of the result of the horizontal difference operation process and the result of the vertical difference operation process and (ii) sends the detected result to the interpolation circuit 22.

Specifically, the edge-distinguishing circuit 36 calculates a ratio a=a1/a2, where a1 is a value of a target pixel in the horizontal difference operation result and a2 is a value of a target pixel in the vertical difference operation result. Then, with the use of the calculated ratio a, an inclined angle θ of the edge is calculated by θ=arctan(a).

Figure 20:
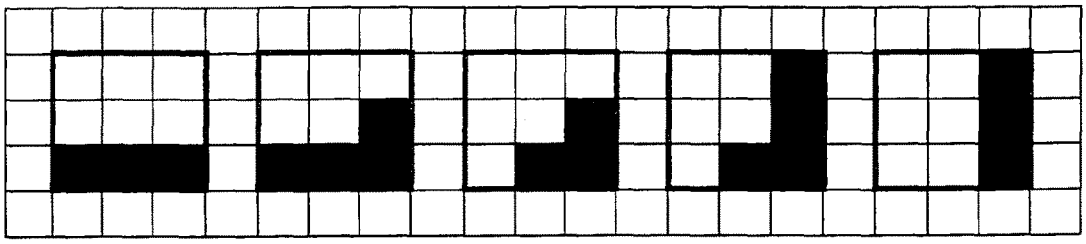
FIG. 20 is an explanatory view illustrating patterns of inclination of an edge expressed by a block of 3×3 dots, according to the liquid crystal display device shown in FIG. 1.

Note that patterns (types) of inclination which can be expressed by a block of 3×3 dots are only 5 types (see FIG. 20). Moreover, in some cases, a value of the ratio a changes due to an effect of noise contained in the inputted image data. Accordingly, it is not necessarily required to exactly calculate the angle θ of the edge direction. That is, it is sufficient as long as the angle θ can be classified into any one of the 5 patterns shown in FIG. 20 or any one of 9 patterns including the 5 patterns shown in FIG. 20 and intermediate inclinations of the 5 patterns. Therefore, it is not necessarily required to directly calculate the value of the ratio a in order to (i) simplify an edge direction detection process and (ii) reduce a circuit size required for detecting an edge direction. For example, the inclination of the edge can be classified, by comparing with a multiplication circuit, into any one of the 5 patterns shown in FIG. 20 or any one of the 9 patterns including the 5 patterns shown in FIG. 20 and intermediate inclinations of the 5 patterns.

Alternatively, a filter of 5×5 dots can be used for detecting an inclination of an edge direction. Patterns of inclination which can be judged in an area of 5×5 dots are 9 types of simple patterns or a dozen of types of patterns when intermediate inclinations of the 9 types are considered. Therefore, when the filter of 5×5 dots is used for judging an edge direction more accurately and an interpolation operation is carried out in accordance with the inclination patterns judged by the filter of 5×5 dots, an edge state can be interpolated appropriately within a larger area, as compared with the case where an inclination is judged by the block of 3×3 dots. However, in a case where a block of 5×5 dots is used for detecting an edge direction, an edge whose direction changes in a short cycle tends to be missed more often than the case where the block of 3×3 dots is used for detection. Therefore, the blocks for detecting inclination of an edge direction can be selected appropriately in accordance with a type or characteristic, etc. of contents to be displayed.

Based on the result of edge detection carried out by the edge-distinguishing circuit 36, the interpolation circuit 22 carries out interpolation processes, on the edge part and the non-edge part, which are suitable for respective characteristics of the edge part and the non-edge part.

Figure 21:
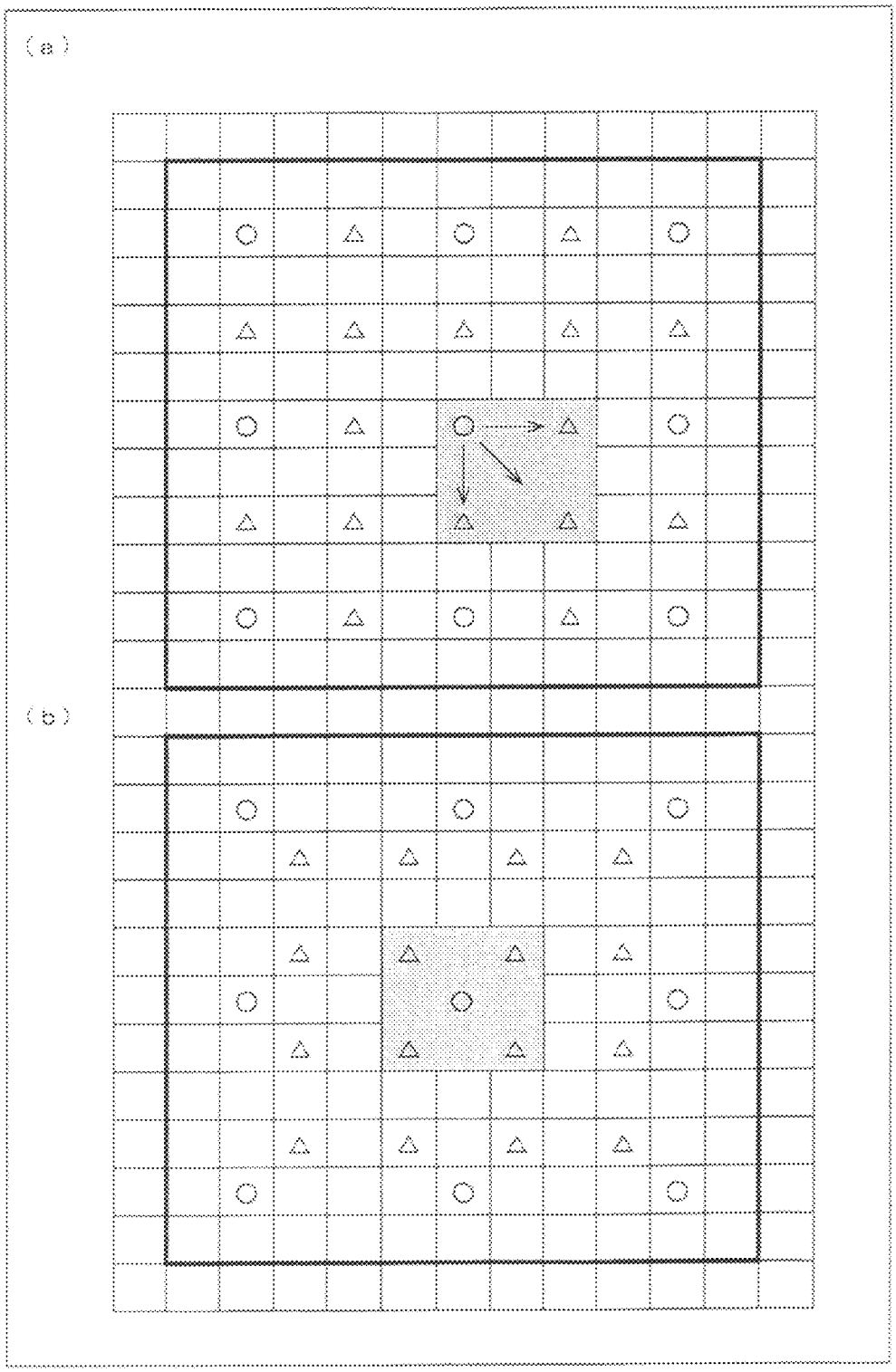
FIG. 21 (a) and (b) of FIG. 21 are explanatory views illustrating examples of an interpolation method used in an upscaling process.

Note that, in a case where inputted image data is upscaled by horizontally and vertically doubling resolution of the inputted image data, two types of interpolation methods can be used (see (a) and (b) of FIG. 21).

As shown in (a) of FIG. 21, according to a first method, pixels (indicated by triangles in the figure) between reference pixels (indicated by circles in the figure) in the inputted image data are interpolated while values (luminance) of the reference pixels remain.

As shown in (b) of FIG. 21, according to a second method, four pixels (indicated by triangles in the figure) surrounding each of reference pixels (indicated by circles in the figure) in the inputted image data are interpolated. According to this method, pixel values (luminance) of the reference pixels do not remain after the interpolation process.

In a case where an inputted image expresses an article having a clear edge and the second method is used for interpolation, the edge may be blurred because pixel values of reference pixels do not remain in the inputted image data. The first method can be carried out by an operation which is easier than that of the second method, whereby a circuit size can be reduced. Therefore, the present embodiment employs the first method. However, the present invention is not limited to this but the second method can be used.

Figure 22:
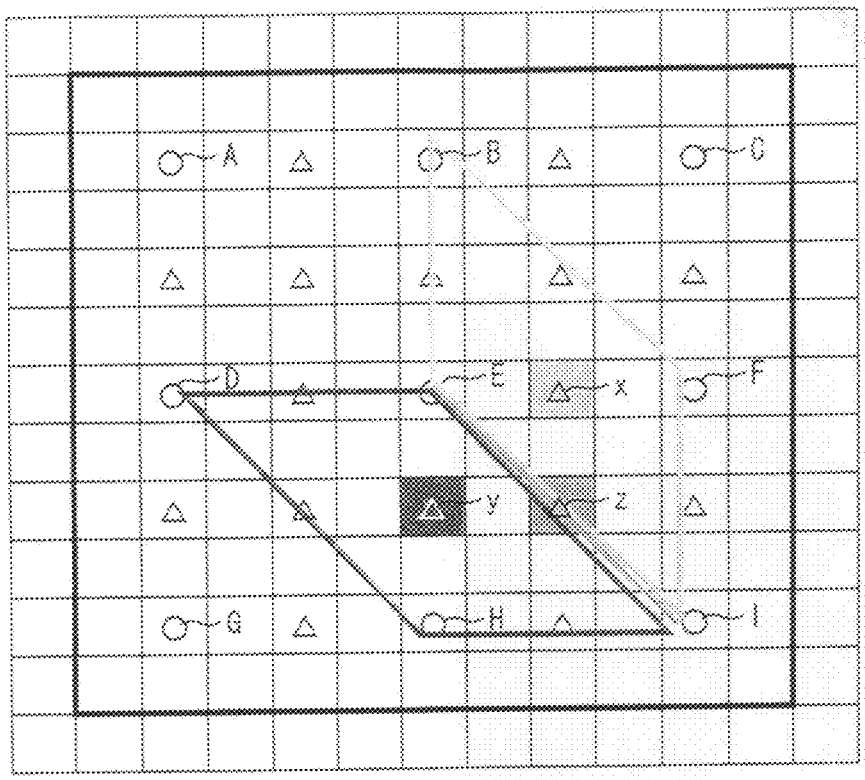
FIG. 22 is an explanatory view illustrating an interpolation method applied to an edge part, according to the liquid crystal display device shown in FIG. 1.

FIG. 22 is an explanatory view illustrating an interpolation method applied to an edge part, where an edge part having an inclination of 1 is interpolated for example.

According to the interpolation method shown in FIG. 22, first, four pixels which surround a pixel to be interpolated are selected. Note that an interpolation operation can be easily carried out when four pixels are selected which are positioned at respective apexes of a parallelogram formed by lines including lines in parallel with the inclination direction of the edge.

Specifically, as shown in FIG. 22, pixels B, E, F, and I are selected as pixels surrounding an interpolation pixel x. Moreover, pixels D, E, H, and I are selected as pixels surrounding an interpolation pixel y. Note that, for an interpolation pixel z which exists on a line which connects pixels adjacent to each other in the edge direction, the pixels (in this case, two pixels) adjacent to each other in the edge direction are selected as pixels surrounding the interpolation pixel z. Then, an average value of the selected surrounding pixels is obtained as a pixel value of corresponding one of the interpolation pixels. That is, z=(E+I)/2, y=(D+E+H+I)/4, and x=(B+E+F+I)/4.

Note that, in a case where inclination of an edge direction is not 1, an average value can be used which is obtained by multiplying each pixel value of surrounding four pixels by a coefficient which is set for each pixel in accordance with a degree of inclination. For example, in a case where an inclination is 2 in FIG. 22, the pixel values of the interpolation pixels can be obtained as follows: z=((3×E+F)/4+(H+3×I)/4)/2, y=((3×E+D)/4+(3×H+I)/4)/2, x=(B+I)/2.

The coefficient in accordance with the inclination of the edge can be set in advance by an approximate calculation, etc. so as to correspond to, for example, the 5 patterns or the 9 patterns which can be expressed by the block of 3×3 dots.

On the other hand, a part which is judged to be a non-edge part (e.g., a part expressing gentle gradation variations or a noise part) is processed by an interpolation method effective for a texture in which an edge does not stand out. The method "effective for a texture" means a process which is (i) centered on maintainability of gradation or hue, and continuity of gradation variations and (ii) relatively effective against noise. Such a method can be, for example, conventionally known various methods such as a bilinear method, a bicubic method, or a lanczos filter method (LANCZOS method). In particular, the LANCZOS method is known as an excellent and simple filter which can be used suitably in a case where an enhancing rate in upscaling is constant (in the present embodiment, resolution is doubled).

As described above, in the present embodiment, operations in display areas in the liquid crystal display panel 2 are controlled based on the plural pieces of divided image data which have been prepared by dividing image data for a single screen in accordance with the display areas in the liquid crystal display panel 2, and operations of the LEDs in the backlight unit 3 are controlled based on image data for a single screen which is not divided.

With the configuration, LEDs in the border area of the display areas can be controlled properly. This makes it possible to prevent decrease of display quality in the border area of the display areas.

Moreover, according to the liquid crystal display device 100 of the present embodiment, in a case where an aspect ratio of inputted image data is different from an aspect ratio of the liquid crystal display panel 2 and accordingly image non-display area occurs in which corresponding inputted image data is not present in a display screen of the liquid crystal display panel 2, luminances of LEDs corresponding to the image non-display area is set based on an average luminance (APL) in an edge area of the image display area. This makes it possible to suppress decrease of image quality in an edge area of an image, and to display a natural image.

Moreover, according to the liquid crystal display device 100 of the present embodiment, in a case where an aspect ratio of inputted image data is different from an aspect ratio of the liquid crystal display panel 2 and accordingly image non-display area occurs in which corresponding inputted image data is not present in a display screen of the liquid crystal display panel 2, the display map generating circuit 16 determines a position in which an image corresponding to the inputted image data is to be displayed in the display screen and thereby generates mapping image data (display map information). Based on the mapping image data, light-emitting luminances of the respective LEDs are set, and the plural pieces of divided image data are compensated. That is, the display map generating circuit 16 generates position information as display map information in order for the liquid crystal display panel 2 to display an image corresponding to inputted image data. The position information as display map information is generated so that positions of images in the plural pieces of divided image data and positions of the images in non-divided image data used for controlling LEDs are conformed to each other. With the configuration, even in a case where an aspect ratio of inputted image data is different from an aspect ratio of the liquid crystal display panel 2, an image corresponding to the inputted image data can be properly displayed. Moreover, in accordance with a position where the image is displayed in accordance with the inputted image data, light-emitting states of the LEDs can be properly controlled.

Moreover, according to the liquid crystal display device 100 of the present embodiment, a correlation value is calculated with the use of (i) difference image data which is obtained by carrying out the difference operation on the inputted image data and (ii) averaged image data which is obtained by carrying out the averaging process on the difference image data, and then an edge part and an edge direction are detected based on the calculated correlation value. This makes it possible to highly-accurately detect an edge part in the inputted image data.

Moreover, according to the present embodiment, it is judged whether or not a target pixel in inputted image data is an edge part based on difference image data and averaged image data which are calculated based on image data of 5×5 dots centered on the target pixel. According to the configuration, when the inputted image data is divided for a plurality of areas, the inputted image data is simply divided into four pieces of divided image data, and each one of the four pieces of divided image data is caused to include image data of 2 nearest lines of dots in each border area of the adjacent ones of the divided areas, the nearest lines being nearest to that one of the divided areas. That is, image data of 2 columns in a border area of the horizontally adjacent divided image data and image data of 2 rows in a border area of the vertically adjacent divided image data are added to (overlap) each one of the four pieces of divided image data. This makes it possible to highly-accurately detect an edge part contained in each piece of the divided image data. That is, it is possible to accurately and separately carry out edge detection and upscaling on each of the divided areas without considering interaction with the other divided areas, by causing each of the divided areas to have a horizontal pixel number of nx/2+2 and a vertical pixel number of ny+2, where nx and ny indicate the horizontal pixel number and the vertical pixel number, respectively, in the inputted image data.

According to the configuration, image data used for an edge detection process can be reduced. This makes it possible to reduce a circuit size and processing time. That is, it is not necessary to check an edge of an article pictured in the whole image, unlike the conventional technique. Accordingly, it is not necessary to send, for edge detection, information of the whole image to each of divided upscaling circuits. Therefore, it is possible to highly-accurately carry out, in each of the upscaling circuits, edge detection without considering interaction with the other divided areas.

Each of the circuits (each block) included in the control device 1 can be realized by software with the use of a processor such as a CPU. That is, the control device 1 can include a CPU (central processing unit), a ROM (read only memory), a RAM (random access memory), and a memory device (memory medium) such as a memory. The CPU executes instructions in control programs for realizing each function. The ROM contains the program which is loaded on the RAM, and the memory device stores the program and various data. The objective of the present invention can also be achieved, by providing the control device 1 with a computer-readable storage medium storing control program codes (executable program, intermediate code program, or source program) for the control device 1, serving as software for realizing the foregoing respective functions, so that the computer (or CPU or MPU) retrieves and executes the program code stored in the storage medium.

The storage medium can be, for example, a tape, such as a magnetic tape or a cassette tape; a disk including (i) a magnetic disk such as a Floppy (Registered Trademark) disk or a hard disk and (ii) an optical disk such as CD-ROM, MO, MD, DVD, or CD-R; a card such as an IC card (memory card) or an optical card; or a semiconductor memory such as a mask ROM, EPROM, EEPROM, or flash ROM.

Alternatively, the control device 1 can be arranged to be connectable to a communications network so that the program codes are delivered over the communications network. The communications network is not limited to a specific one, and therefore can be, for example, the Internet, an intranet, extranet, LAN, ISDN, VAN, CATV communications network, virtual private network, telephone line network, mobile communications network, or satellite communications network. The transfer medium which constitutes the communications network is not limited to a specific one, and therefore can be, for example, wired line such as IEEE 1394, USB, electric power line, cable TV line, telephone line, or ADSL line; or wireless such as infrared radiation (IrDA, remote control), Bluetooth (Registered Trademark), 802.11 wireless, HDR, mobile telephone network, satellite line, or terrestrial digital network. Note that, the present invention can be realized by a computer data signal (i) which is realized by electronic transmission of the program code and (ii) which is embedded in a carrier wave.

Each of the circuits (each block) included in the control device 1 can be realized by any of (i) software, (ii) hardware logic, and (iii) a combination of hardware which carries out part of a process and a operation means which executes software for carrying out control of the hardware and the rest of the process.

The present invention is not limited to the description of the embodiments above, but can be altered by a skilled person in the art within the scope of the claims. An embodiment derived from a proper combination of technical means disclosed in respective different embodiments is also encompassed in the technical scope of the present invention.

INDUSTRIAL APPLICABILITY

The present invention can be used in a liquid crystal display device in which display states of display areas of a liquid crystal display panel are controlled based on a plural pieces of divided image data, which is obtained by dividing image data for a single screen into the plural pieces of divided image data for the plurality of display areas of the liquid crystal display panel.

The invention claimed is:

1. A control device for controlling operations of a liquid crystal display device which includes a liquid crystal display panel and a backlight unit having a plurality of light sources arranged in a matrix manner in a backside of the liquid crystal display panel, said control device comprising:

a liquid crystal control section which controls pixels of the liquid crystal display panel in accordance with plural pieces of divided image data, the plural pieces of divided image data being prepared by dividing image data for a single screen into pieces for respective ones of a plurality of display areas of the liquid crystal display panel;

a backlight control section which controls light-emitting states of respective ones of the plurality of light sources in accordance with undivided image data for a single screen;

a first dividing section which divides inputted image data for a single screen into the plural pieces of divided image data, the inputted image data having a first resolution which is at least a threshold resolution; and a down-converting section which converts the first resolution of the inputted image data into a second resolution lower than the first resolution, the backlight control section including, a light source luminance setting section which determines light-emitting luminances of the respective ones of the plurality of light sources in accordance with the undivided image data for the single screen;

a light source driving section which causes the plurality of light sources to emit light in accordance with the respective light-emitting luminances determined by the light source luminance setting section; and a luminance distribution data generating section which generates luminance distribution data indicative of luminance distribution caused in the liquid crystal display panel due to light emitted by the plurality of light sources, the plurality of light sources emitting the light according to the respective light-emitting luminances determined by the light source luminance setting section, the liquid crystal control section including, a compensating section which compensates the plural pieces of divided image data in accordance with the luminance distribution data; and a liquid crystal driving section which drives the pixels of the liquid crystal display panel in accordance with the plural pieces of divided image data compensated by the compensating section, the light source luminance setting section being configured to determine the light-emitting luminances of the respective ones of the plurality of light sources in accordance with the second resolution of the inputted image data, and in accordance with the luminance distribution data, the compensating section being configured to compensate the plural pieces of divided image data prepared by the first dividing section.

2. The control device as set forth in claim 1, further comprising:

an image size adjusting section which adjusts an image size of inputted image data for a single screen in a case where an aspect ratio of the inputted image data is different from an aspect ratio of the liquid crystal display panel, the image size adjusting section is configured to add dummy image data to a periphery of the inputted image data so as to adjust the image size of inputted image data, so that the aspect ratio of the inputted image data conforms to the aspect ratio of the liquid crystal display panel, and the light source luminance setting section is configured to determine the light-emitting luminances of the respective ones of the plurality of light sources in accordance with image data whose image size has been adjusted by the image size adjusting section.

3. The control device as set forth in claim 2, wherein:

the light source luminance setting section is configured to, divide image data for a single screen into a plurality of blocks which correspond to respective positions in which the plurality of light sources are provided, determine a light-emitting luminance of each light source in an image display area among the plurality of light sources in accordance with a maximum value among gradation values of pixels included in that one of the plurality of blocks corresponding to the light source, the image display area being an area for displaying an image corresponding to the inputted image data, and determine a light-emitting luminance of each light source in an image non-display area among the plurality of light sources in accordance with (i) an average luminance level of pixels included in a block of an image display area adjacent to a block corresponding to the light source, the image non-display area being an area in which an image corresponding to the dummy image data is displayed, or (ii) an average luminance level of some of a plurality of small blocks which are adjacent to the image non-display area, the plurality of small blocks being obtained by further dividing the block of the image display area adjacent to the block corresponding to the light source.

4. The control device as set forth in claim 1, further comprising:

an image restoring section which (i) receives the plural pieces of divided image data which have been prepared by dividing the image data for a single screen, and (ii) restores the image data for the single screen by combining the plural pieces of divided image data; and the down-converting section is configured to convert a resolution of the image data thus restored into a resolution lower than the resolution of the image data thus restored, the light source luminance setting section is configured to determine the light-emitting luminances of the respective ones of the plurality of light sources in accordance with the image data whose resolution has been lowered by the down-converting section, and in accordance with the luminance distribution data, the compensating section is configured to compensate the plural pieces of divided image data.

5. The control device as set forth in claim 1, further comprising:

a second dividing section which divides second inputted image data for a single screen into a second plural pieces of divided image data, the second inputted image data having a resolution less than a threshold resolution; and an upscaling process section which enhances resolutions of the second plural pieces of divided image data so that the resolutions become higher than the resolutions of the second plural pieces of divided image data, the second plural pieces of divided image data having been prepared by the second dividing section, the light source luminance setting section is configured to determine the light-emitting luminances of the respective ones of the plurality of light sources in accordance with the inputted image data for the single screen, and in accordance with the luminance distribution data, the compensating section is configured to compensate the second plural pieces of divided image data whose resolutions have been enhanced by the upscaling process section.

6. The control device as set forth in claim 5, wherein:

the second dividing section is configured to generate the second plural pieces of divided image data so that each one of the second plural pieces of divided image data shares a portion with its adjacent one of the second plural pieces of divided image data, so that border areas of that one and its adjacent one of the second plural pieces of divided image data overlap each other, the upscaling process section includes a difference operation section which carries out a difference operation process in which a gradation value of a target pixel is calculated by an operation with use of differentiation or difference of gradation values in vicinity to the target pixel, the gradation value of the target pixel being used for extracting an edge of an article pictured in an image, an averaging process section which carries out an averaging process in which an average value of the gradation values in vicinity to the target pixel is calculated as a gradation value of the target pixel, a correlation operation section which carries out calculation process for obtaining a correlation value indicative of a correlation between difference image data and averaged image data, the difference image data being produced by subjecting the second plural pieces of divided image data to the difference operation process, and the averaged image data being produced by subjecting the second plural pieces of divided image data to the difference operation process and the averaging process; and an interpolation process section which carries out an interpolation process on the second plural pieces of divided image data with use of an interpolation method which is selected in accordance with the correlation value.

7. A liquid crystal display device, comprising:

a liquid crystal display panel;

a backlight unit having a plurality of light sources arranged in a matrix manner in a backside of the liquid crystal display panel; and a control device as set forth in claim 1.

8. A method for controlling a liquid crystal display device which includes a liquid crystal display panel and a backlight unit having a plurality of light sources arranged in a matrix manner in a backside of the liquid crystal display panel, said method comprising the steps of:

dividing inputted image data for a single screen into plural pieces of divided image data, the dividing divides the inputted image data for the single screen into pieces for respective ones of a plurality of display areas of the liquid crystal display panel, the inputted image data having at least a first resolution;

controlling display states of the plurality of display areas in accordance with the plural pieces of divided image data;

controlling light-emitting states of respective ones of the plurality of light sources in accordance with undivided image data for a single screen, the controlling the light-emitting states including, determining light-emitting luminances of the respective ones of the plurality of light sources in accordance with the undivided image data for the single screen;

causing the plurality of light sources to emit light in accordance with the respective light-emitting luminances; and generating luminance distribution data indicative of luminance distribution caused in the liquid crystal display panel due to light emitted by the plurality of light sources, the plurality of light sources emitting the light according to the respective light-emitting luminances, the controlling the display states including, compensating the plural pieces of divided image data in accordance with the luminance distribution data; and driving the pixels of the liquid crystal display panel in accordance with the compensated plural pieces of divided image data; and converting the first resolution of the inputted image data into a second resolution lower than first resolution of the inputted image data, wherein the determining light-emitting luminances determines the light-emitting luminances of the respective ones the plurality of light sources in accordance with the second resolution of the inputted image data.

9. A non-transitory computer-readable storage medium storing a program for causing a computer to operate as the liquid crystal control section and the backlight control section of claim 1.

10. The control device as set forth in claim 1, wherein the compensating section includes a plurality of compensating section parts, each of the plurality of compensating section parts is associated with one of the plural pieces of divided image data.

11. The control device as set forth in claim 1, wherein the liquid crystal driving section includes a plurality of liquid crystal driving section parts, each of the plurality of liquid crystal driving section parts is associated with one of the plural pieces of divided image data.

* * * * *